US008530796B2

(12) United States Patent
Hirano et al.

(10) Patent No.: US 8,530,796 B2
(45) Date of Patent: Sep. 10, 2013

(54) COOKING DEVICE

(75) Inventors: Seiichi Hirano, Osaka (JP); Tatsuhiko Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1278 days.

(21) Appl. No.: 12/351,910

(22) Filed: Jan. 12, 2009

(65) Prior Publication Data

US 2009/0184104 A1 Jul. 23, 2009

(30) Foreign Application Priority Data

Jan. 22, 2008 (JP) ..... 2008-011989

(51) Int. Cl.
*F24C 7/02* (2006.01)
*F24C 7/08* (2006.01)
*F24C 15/20* (2006.01)

(52) U.S. Cl.
USPC ..... 219/400; 219/399; 219/757; 126/21 A; 99/474

(58) Field of Classification Search
None
See application file for complete search history.

(56) References Cited

U.S. PATENT DOCUMENTS

| | | | | |
|---|---|---|---|---|
| 3,170,621 | A * | 2/1965 | Maynard | 417/368 |
| 3,485,229 | A * | 12/1969 | Gilliom | 126/21 A |
| 3,973,551 | A | 8/1976 | Caselani et al. | |
| 4,331,124 | A * | 5/1982 | Seidel et al. | 126/21 A |
| 4,601,279 | A * | 7/1986 | Guerin | 126/21 A |
| 6,621,057 | B2 * | 9/2003 | Kim | 219/757 |
| 7,022,958 | B2 * | 4/2006 | Yamauchi et al. | 219/757 |
| 7,547,862 | B2 * | 6/2009 | Kim et al. | 219/400 |
| 7,856,973 | B2 * | 12/2010 | Kim et al. | 126/273 R |
| 2007/0158330 | A1 * | 7/2007 | Kim et al. | 219/400 |
| 2007/0163567 | A1 * | 7/2007 | Kaneko et al. | 126/21 A |
| 2008/0156796 | A1 * | 7/2008 | Song et al. | 219/757 |
| 2009/0183724 | A1 * | 7/2009 | Hirano et al. | 126/21 A |
| 2009/0255919 | A1 * | 10/2009 | Venezia et al. | 219/399 |

FOREIGN PATENT DOCUMENTS

| | | | |
|---|---|---|---|
| EP | 1 542 510 | A1 | 6/2005 |
| EP | 1 798 484 | A2 | 6/2007 |
| JP | 54-32849 | U | 3/1979 |
| JP | 60-26199 | A | 2/1985 |
| JP | 61-46498 | A | 3/1986 |
| JP | 4-106401 | U | 9/1992 |
| JP | 06-185736 | A | 7/1994 |
| JP | 2000-274693 | A | 10/2000 |
| JP | 2005-241182 | A | 9/2005 |
| JP | 2007-155224 | A | 6/2007 |

* cited by examiner

*Primary Examiner* — Joseph M Pelham
(74) *Attorney, Agent, or Firm* — Birch, Stewart, Kolasch & Birch, LLP

(57) ABSTRACT

A cooking device comprises a cooking device body comprising a heating chamber for heating an object; a fan, comprising a bladed wheel and a casing having the bladed wheel in rotatable manner, to discharge air in the heating chamber; and an exhaust duct comprising an exhaust guide plane to guide the air blown out by the fan to the outside of the cooking device body. The casing comprises an arc-shaped guide plane to guide an air flow generated by a rotation of the bladed wheel in a rotation direction of the bladed wheel, and an outlet port opened from a part of the arc-shaped guide plane to one side in a tangent direction of the arc-shaped guide plane. The rotation direction of the bladed wheel is a direction opposite to the opening direction of the outlet port, and turbulence is generated in the exhaust duct.

4 Claims, 24 Drawing Sheets

11

COOKING DEVICE

This Nonprovisional application claims priority under 35 U.S.C. §119(a) on Patent Application No. 2008-011989 filed in Japan on Jan. 22, 2008, the entire contents of which are hereby incorporated by reference.

BACKGROUND OF THE INVENTION

1. Field of the Invention

The present invention relates to a cooking device such as a microwave oven for cooking an object.

2. Description of Related Art

Japanese Patent Application Laid-Open No. 06-185736 discloses a cooking device that comprises a cooking device body with a heating chamber for heating an object and with an electromagnetic generating section for generating cooking heat in the heating chamber. This cooking device further comprises an exhaust duct that is provided on the top of the heating chamber to discharge air in the heating chamber from an exhaust port to the outside and a fan that is utilized for supplying air from the outside into the heating chamber. This cooking device is configured to discharge the air, which is supplied into the heating chamber by driving the fan, from the exhaust port to the outside through the exhaust duct.

In such a cooking device, an electromagnetic supply unit supplies electromagnetic waves generated by an electromagnetic generating unit to the heating chamber, and then an object kept inside of the heating chamber is heated. In addition, driving the fan supplies air to the heating chamber, the air contains hot air and steam that are generated by the heated object, and then the air is discharged from the exhaust port to the outside through the exhaust duct.

SUMMARY OF THE INVENTION

However, the cooking device does not have a perfect airtight structure, because there are clearance gaps, such as small gaps in the joint section of metal sheets that constitutes the heating chamber, a slight gap between the heating chamber and a door for opening and closing the heating chamber, and a slight gap between the electromagnetic supply unit and a mount section that mounts a sensor for detecting an operation of the electromagnetic generating unit, or the like. Therefore, in the case where the fan is disposed in an air intake path for supplying air into the heating chamber as disclosed in Japanese Patent Application Laid-Open No. 06-185736, the hot air and steam in the heating chamber may be blown out from the clearance gaps because the heating chamber has a positive pressure. Furthermore, a user may be exposed to the hot air and steam when opening the door after finishing cooking. Thus, it is desirable to provide an approach to improve.

FIG. 24 is a schematic perspective view showing the relationship between a fan and an exhaust duct in a cooking device, which the applicants of the present invention have developed previously. As shown in FIG. 24, the applicants of the present invention have previously developed a cooking device that is configured to locate a fan 102 in an exhaust dust 101 which is allowed to discharge air in a heating chamber 100, that sucks the air in the heating chamber 100 into the exhaust duct 101, that keeps the pressure in the heating chamber 100 to be negative, and that is intended to prevent blowing out of the air and steam from any section other than an exhaust port.

Cooking devices in countries like Japan and USA are usually designed to operate at a supply voltage of from 100 Volts to 130 Volts. In such countries, heating capacity of cooking devices for home use rarely exceeds 2000 W mostly because the supply current is limited to around 15 A due to household electric wiring regulations.

In other countries, especially in Europe in general, while supply voltage ranges from 220 Volts to 240 Volts, heating capacity of cooking devices are more or less the same even without limitation due to supply currents.

On the other hand, a cooking device in a kitchen for business use is operated at a supply voltage of 200 V, or over 200 V, because preferring a short-time cooking. For example, the supply voltage is often to be a high voltage up to 240 V to obtain a high output power, for utilizing constant heating ability.

The reason is that the supply voltage and the supply current are in inverse proportion. In other words, if the supply capacity is constant, the heating ability is proportional to the supply voltage. Accordingly, it is possible to use a cooking device of high output power reaching 2500 to 3000 W.

However, regarding high-frequency heating, a high output power exceeding 2000 W is rarely provided in a single high frequency generating device. Such a high frequency generating device is very expensive. It is feasible at lower costs for obtaining high output power reaching around 2000 W by using a pair of standard high-frequency heating devices that have output power around 1000 W, rather than such a single high frequency generating device.

Regarding the cooking device for home use, such a cooking device with high output power is inevitably expensive. In addition, it has been widely recognized that the high-frequency cooking device already has sufficient high speed. Therefore, it is unusual to employ such a high-output high-frequency cooking device in a house for the purpose of shortening the cooking time, even in the case that the house is supplied with a high voltage of around 200 V or higher.

As one of trends of cooking devices for home use, it tends to provide an automatic cooking control that detects the progress of cooking with cooking sensors, such as a steam sensor, and that determines the end of cooking in order to cook various types of objects automatically.

Usually, when cooking is continued for an object, the object is over-heated and turns into a dried state due to complete evaporation of its moisture content. In this state, the object cannot limit an increase of temperature of itself by evaporative latent heat of moisture. It has a possibility that the object ignites when the object is over-heated beyond the firing point. However, the cooking device for home use limits the heating capacity and provides a safety device, such as an overheating preventive device. Therefore, there is a low possibility that the object is overheated until igniting, unless the user dare use manual heat setting to override the operation of the safety device cook and dare cook a highly dried object for a long time.

On the other hand, the cooking devices for business use are originally set to be able to perform high output heating, and are preferably selected to use a heat control similar to manual heat settings that sets a cooking time for each cooking menu (recipe) rather than automatic cooking settings that uses cooking sensors.

Therefore, in the case where performing wrong operation causes an abnormal heating condition, such as when a wrong cooking menu is applied to an object, there is a possibility that overheating occurs in an extremely short time and that the object ignites.

Moreover, the cooking devices for business use are often designed based on a design policy, which allows the object to ignite unless fire spread to the periphery, because unwilling to lower an operation efficiency for ordinary cooking by incorporating safety measures. Further, another reason allowing the above mentioned design policy is that flammable objects are not placed around, particularly behind the cooking devices in general, because of safety standards for preventing fire in kitchens for business use.

It is needless to say that, in such cooking devices for business use, whole of the heating chamber is made of heat-resistant materials resisting fire and burning.

Thus, in a high output cooking device for business use, there is a possibility to ignite an object that is heated and cooked in the heating chamber during cooking. However, in the cooking device that arranges the fan 102 in the exhaust duct 101 as shown in FIG. 24, if an object during cooking catches fire, there is a possibility that a part of flames in the heating chamber 100 moves into the exhaust duct from an exhaust port in the top of the heating chamber, is sucked into a suction port of the fan, further moves along with a directional air flow which is blown by the fan, and reaches to the exhaust port through the exhaust duct 101. The reason is that an air flow in the exhaust duct has directivity and is unevenly distributed on the cross-sectional surface of the exhaust duct because the fan has a nozzle-shaped outlet port of a casing which performs a blowing operation.

In order to prevent flames in the heating chamber from reaching to the exhaust port through the exhaust duct, a conventional cooking device may use a relatively long exhaust duct, or places a net-like metal flame damper material in the exhaust duct. However, an introduction of the relatively long exhaust duct causes to increase the entire size of the cooking device with respect to the capacity of the heating chamber, and an introduction of the flame damper material may tend to be clogged with lamp black and dust, followed by reducing the amount of exhaust. Therefore, it is desirable to provide an approach to improve.

As a known improvement approach, it may be considered to provide an obstacle plate for partly blocking the air flow in the exhaust duct to disturb the exhausted air flow and facilitate extinction of flames. However, in the case where bolts and nuts are used as fastening parts to fix the obstacle plate, it requires additional parts fee and assembly steps, followed by increasing the total costs. In the case where welding means such as spot welding is used to fix the obstacle plate in the exhaust duct, it limits materials of both welded parts and requires suitable surface treatment for the both welded parts. Furthermore, it may cause a problem that a high temperature for welding degrades the surface treatment of the both welded parts, and that oxidation and corrosion start at the degraded welded parts. Hence, it is difficult to use such an improvement approach with an obstacle plate for the exhaust duct of the cooking device, when considering the aspects of cost reduction and ensuring reliability.

The present invention has been made with the aim of solving the above problems. A main object of the invention is to provide a cooking device having a fan for discharging air of a heating chamber and an exhaust duct for guiding air blown by the fan to the outside of the cooking device body, that is capable of giving directivity to air containing flames, causing the air to strike an exhaust guide plane, and generating vortex turbulence when blowing the air containing flames in the heating chamber from an outlet port into the exhaust duct, by arranging the blowing direction of the fan to cross the exhaust guide plane.

In the case where the fan is arranged in the air intake path that supplies air into the heating chamber as disclosed in Japanese Patent Application Laid-Open No. 06-185736, the exhaust duct does not provide interiorly a nozzle-like structure for the blowing operation. Thus, it has a characteristic that flames are extinguished within a relatively short distance even if burning occurs in the heating chamber, because the exhaust duct guides orderly the exhaust which is sent from the opening formed in the top of the heating chamber into the exhaust duct.

A cooking device according to the first aspect of the invention comprises, a cooking device body having a heating chamber that heats an object; a fan that discharges air of the heating chamber; and an exhaust duct having an exhaust guide plane that guides the air discharged by the fan from the fan to the outside of the cooking device body, wherein a blowing direction of the air discharged by the fan crosses the exhaust guide plane.

In the cooking device according to the first aspect, when air containing flames in the heating chamber is discharged from an outlet port of the fan into the exhaust duct, it is possible to make the air containing flames strike the exhaust guide plane, and it is possible to generate vortex turbulence by the strike. Therefore, this configuration can block discharge of the flames in the heating chamber from the exhaust duct to the outside, without increasing the entire length of the exhaust duct or increasing the number of parts.

A cooking device according to the second aspect of the invention is a device, wherein an angle of the blowing direction with respect to the exhaust guide plane is between 20 degrees and 85 degrees.

In the cooking device according to the second aspect, it is possible to further reduce the possibility of discharging the flames in the heating chamber from the exhaust duct to the outside, because a vortex turbulence can be generated in the entire air blown from the outlet port of the fan into the exhaust duct.

When it exceeds 85 degrees for the angle of the blowing direction with respect to the exhaust guide plane, resistance is increased to interfere the movement of air toward the exhaust duct, and the amount of air blowing into the exhaust duct may be smaller. When it does not exceed 20 degrees for the angle of the blowing direction with respect to the exhaust guide plane, the blown air is reduced amounts of the strike on the exhaust guide plane and the turbulence becomes weaker. Consequently, the flames in the heating chamber may be easily discharged from the exhaust duct to the outside.

A cooking device according to a third aspect of the invention, comprises a cooking device body having a heating chamber that heats an object; a fan, having a bladed wheel and a casing which provides the bladed wheel in a rotatable manner, that discharges air of the heating chamber; and an exhaust duct having an exhaust guide plane that guides the air discharged by the fan from the fan to the outside of the cooking device body, wherein the casing comprises: an arc-shaped guide plane that guides an air flow generated by a rotation of the bladed wheel; and an outlet port that protrudes from a part of the arc-shaped guide plane in a tangent direction of the arc-shaped guide plane; and a direction of the rotation of the bladed wheel is opposite to a protruding direction of the outlet port.

In the cooking device according to the third aspect, a reverse rotation of the bladed wheel of the fan can allow the guided air by the guide plane to strike on an inner surface of the outlet port. Therefore, it is possible to generate the vortex turbulence in the air containing flames and to prevent the discharge of the flames in the heating chamber from the exhaust duct to the outside, without increasing the entire length of the exhaust duct or increasing the number of parts.

A cooking device according to the fourth aspect of the invention, comprises a multiblade bladed wheel, as the bladed wheel, that consists of a plurality of blades arranged each rotation center side portion rearward in the direction of the rotation with respect to each outside edge.

In the cooking device according to the fourth aspect, an existing centrifugal fan can be utilized that has a multiblade bladed wheel. Then, it is possible to generate the vortex turbulence in the air containing flames and to prevent the discharge of the flames in the heating chamber from the exhaust duct to the outside, by a reverse rotation of the multiblade bladed wheel of the existing centrifugal fan.

A cooking device according to the fifth aspect of the invention, comprises a cooking device body having a heating chamber that heats an object; a fan, having bladed wheel and a casing which provides the bladed wheel in a rotatable manner, that discharges air of the heating chamber; and an exhaust duct having an exhaust guide plane that guides the air discharged by the fan from the fan to the outside of the cooking device body, wherein the casing comprises: an arc-shaped guide plane that guides an air flow, generated by a rotation of the bladed wheel, in a direction of the rotation of the bladed wheel; and an outlet port that protrudes from a part of the arc-shaped guide plane in a tangent direction of the arc-shaped guide plane; and the exhaust guide plane comprises a projection that projects across a protruding direction of the outlet port.

In the cooking device according to the fifth aspect, it is possible to generate the vortex turbulence in the air containing flames and to prevent the discharge of the flames in the heating chamber from the exhaust duct to the outside, by using the existing fan and providing the projection in a part of the exhaust guide plane.

The above and further objects and features of the invention will more fully be apparent from the following detailed description with accompanying drawings.

DESCRIPTION OF THE PREFERRED EMBODIMENTS

The following description will explain in detail the present invention, based on the drawings illustrating some embodiments thereof (Embodiment 1)

Figure 1:
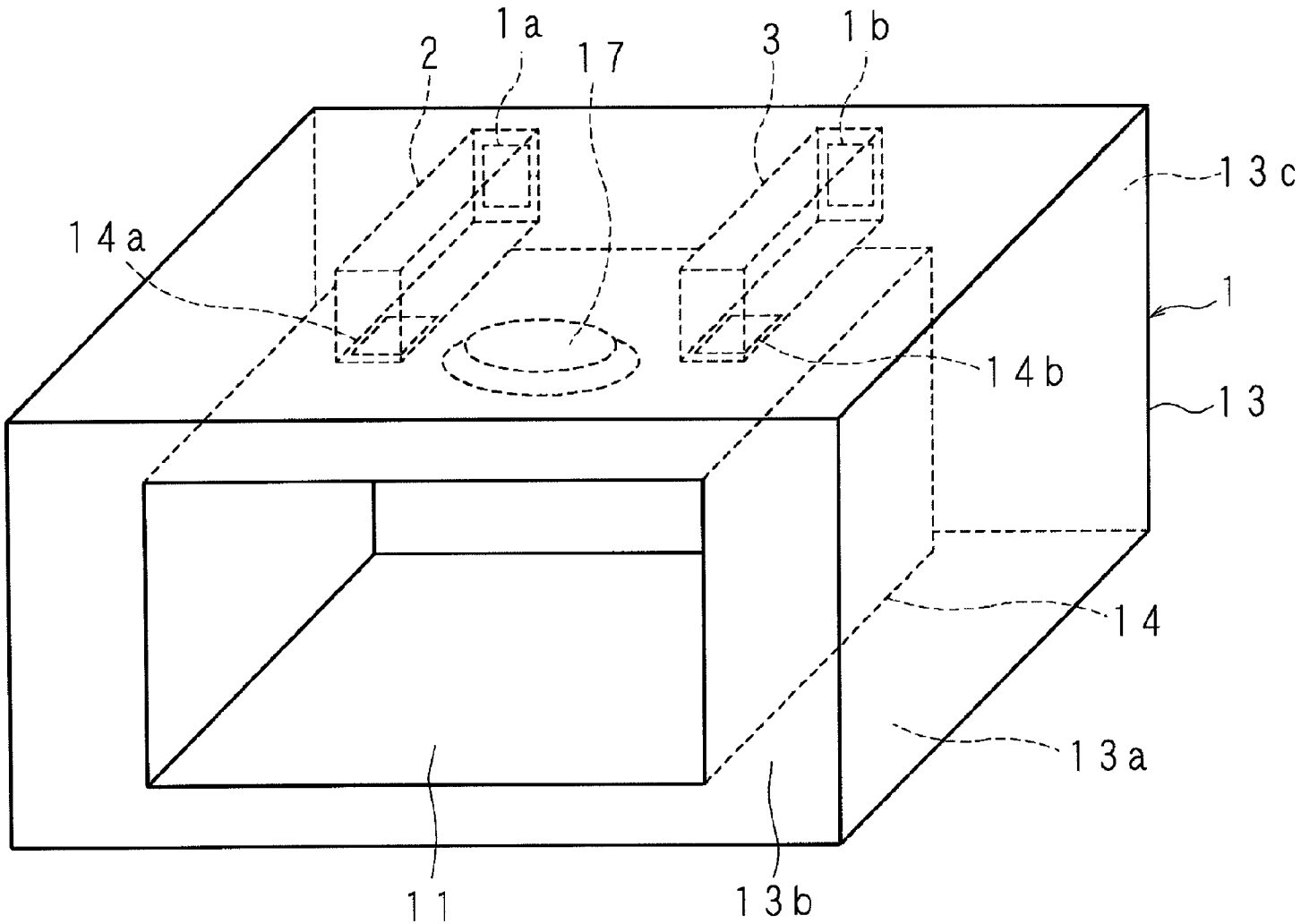
FIG. 1 is a schematic perspective view showing the structure of a cooking device according to the present invention.
Figure 2:
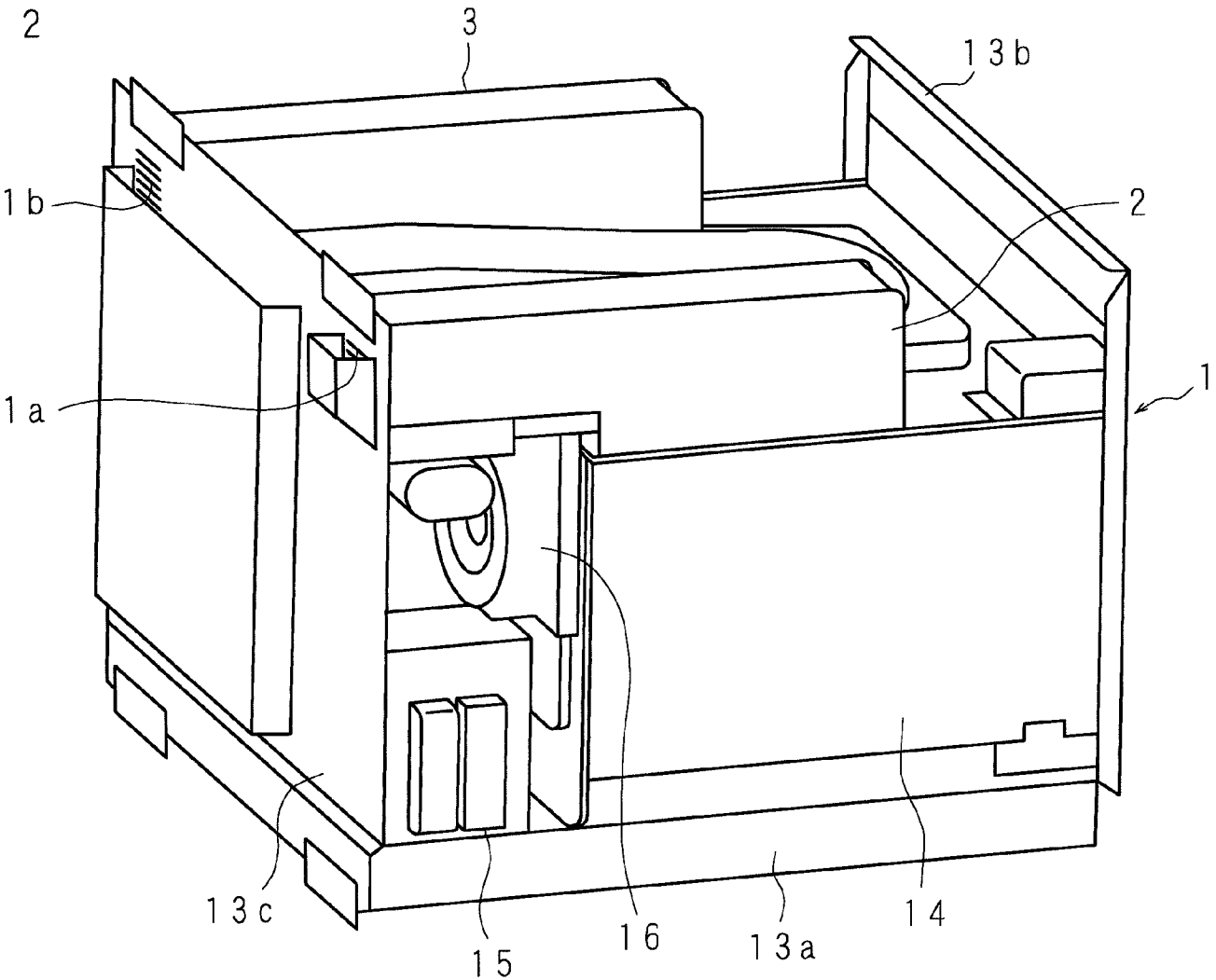
FIG. 2 is a partly omitted rear perspective view showing the structure of the cooking device according to the present invention.
Figure 3:
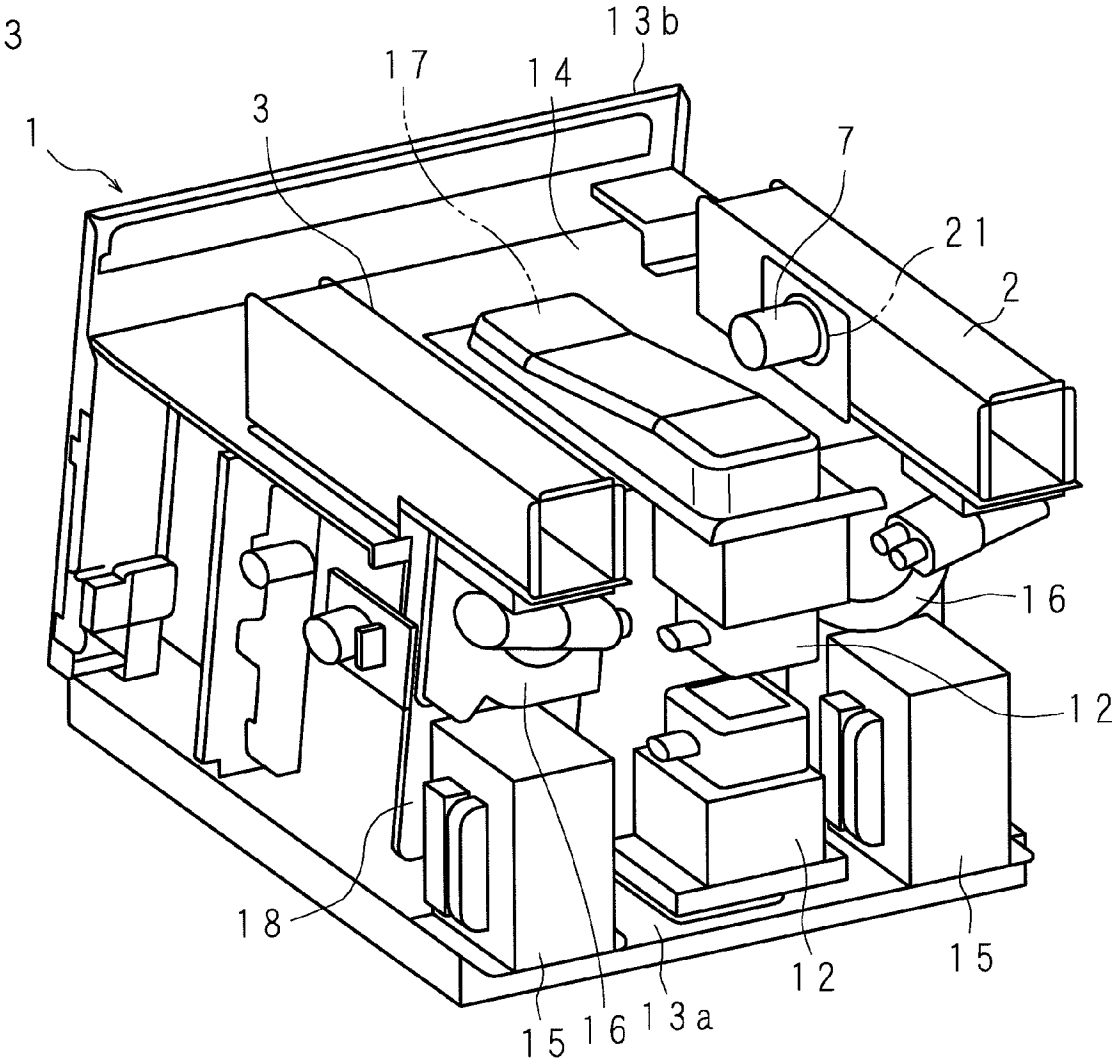
FIG. 3 is a partly omitted rear perspective view showing the structure of the cooking device according to the present invention.
Figure 4:
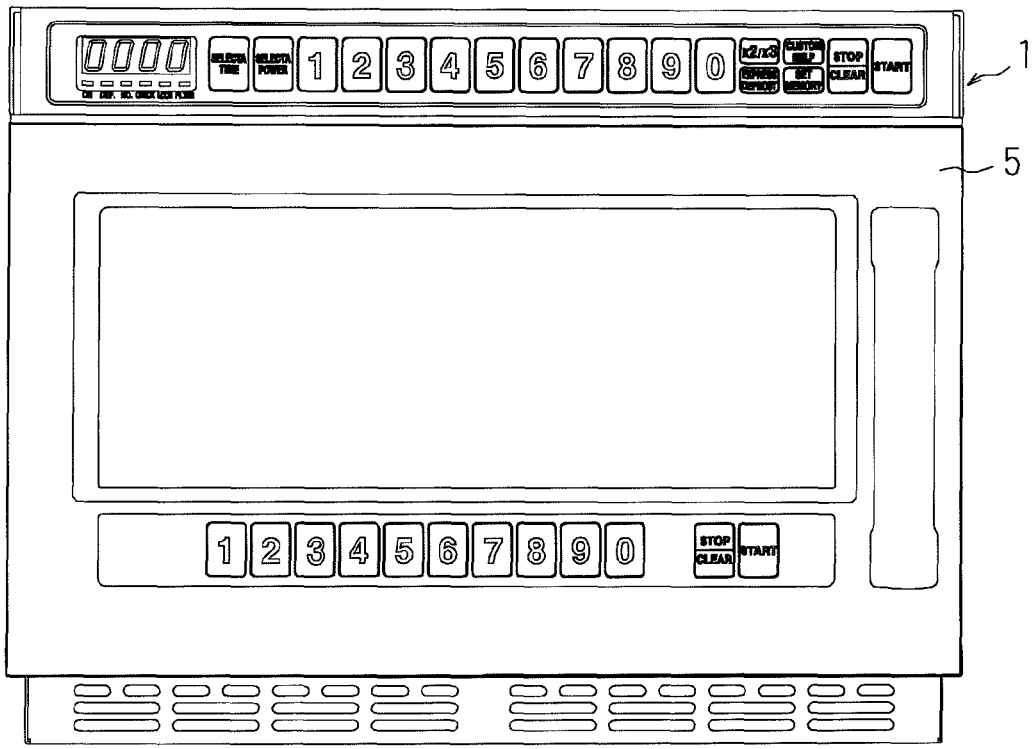
FIG. 4 is a front view showing the structure of the cooking device according to the present invention.
Figure 5:
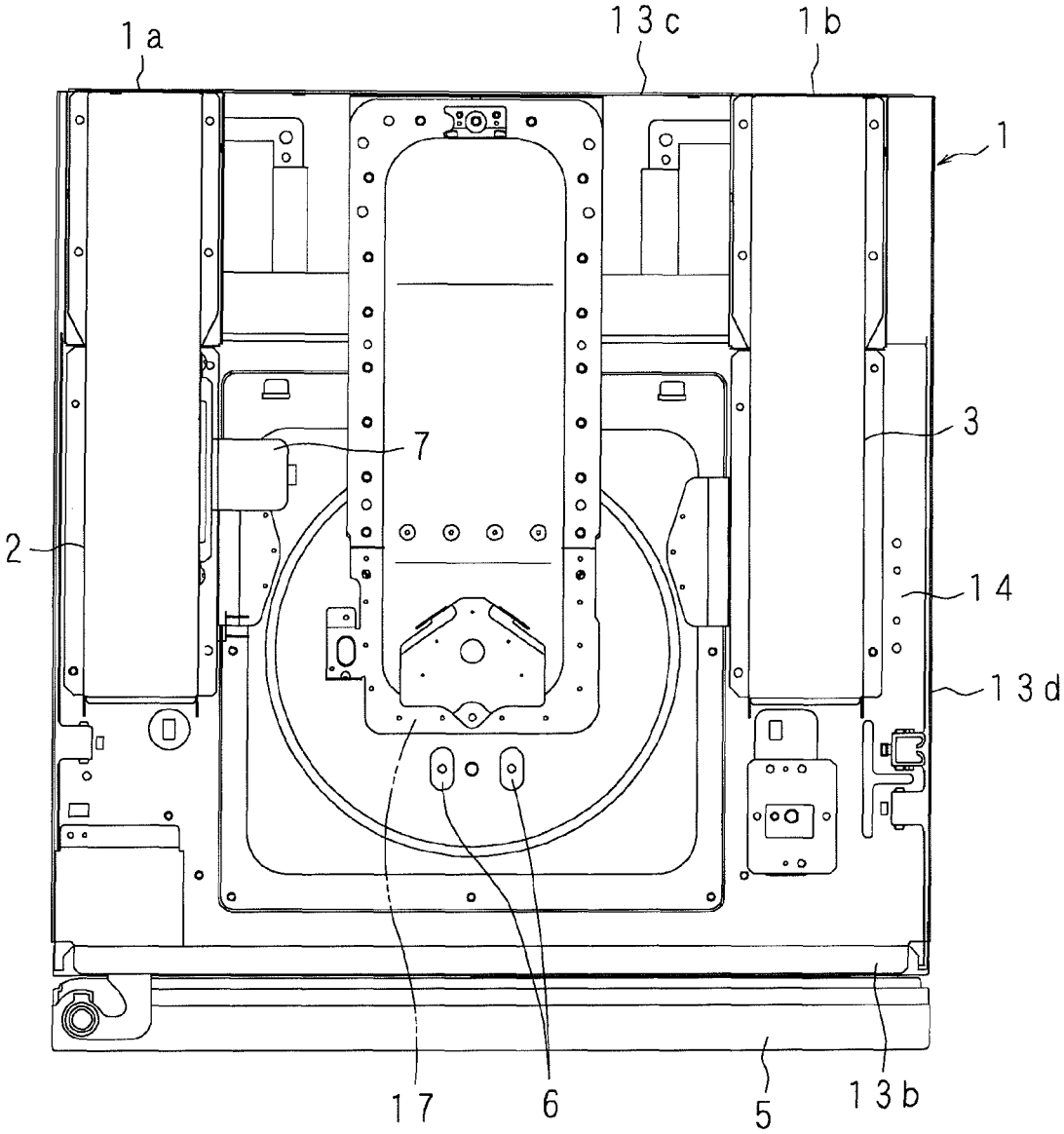
FIG. 5 is a partly omitted plan view showing the structure of the cooking device according to the present invention.
Figure 6:
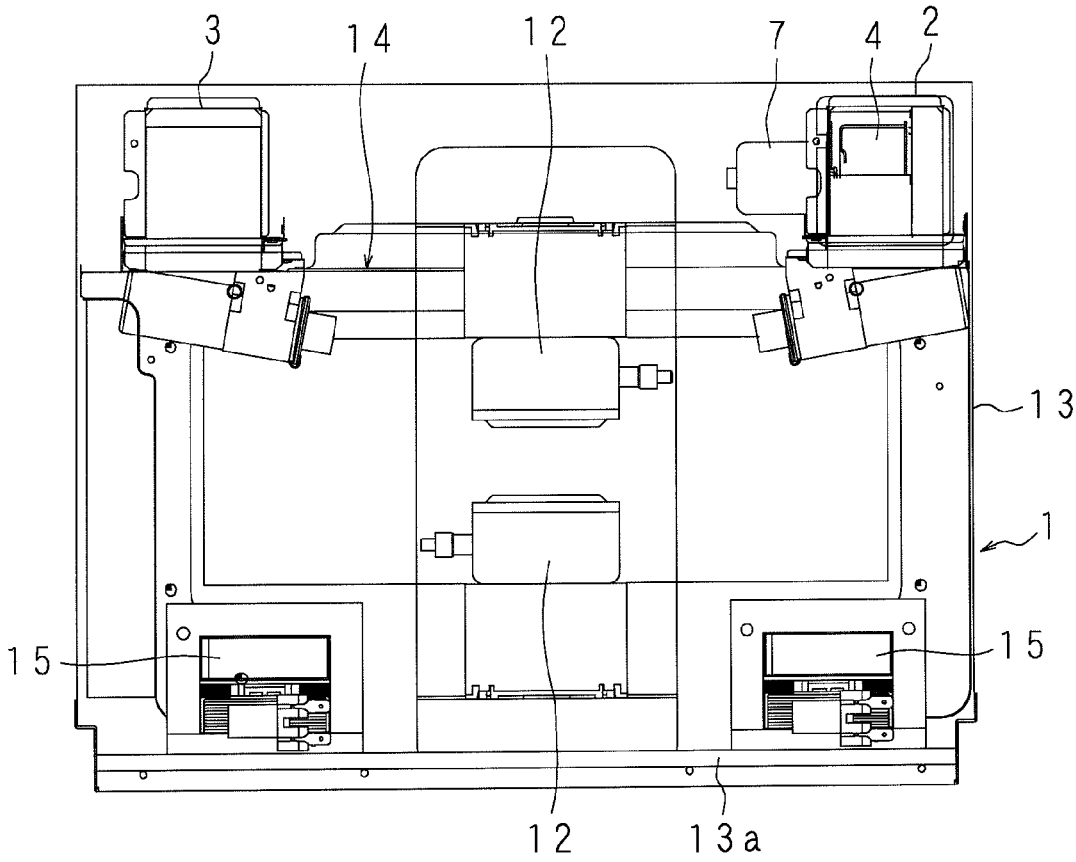
FIG. 6 is a partly omitted rear view showing the structure of the cooking device according to the present invention.
Figure 7:
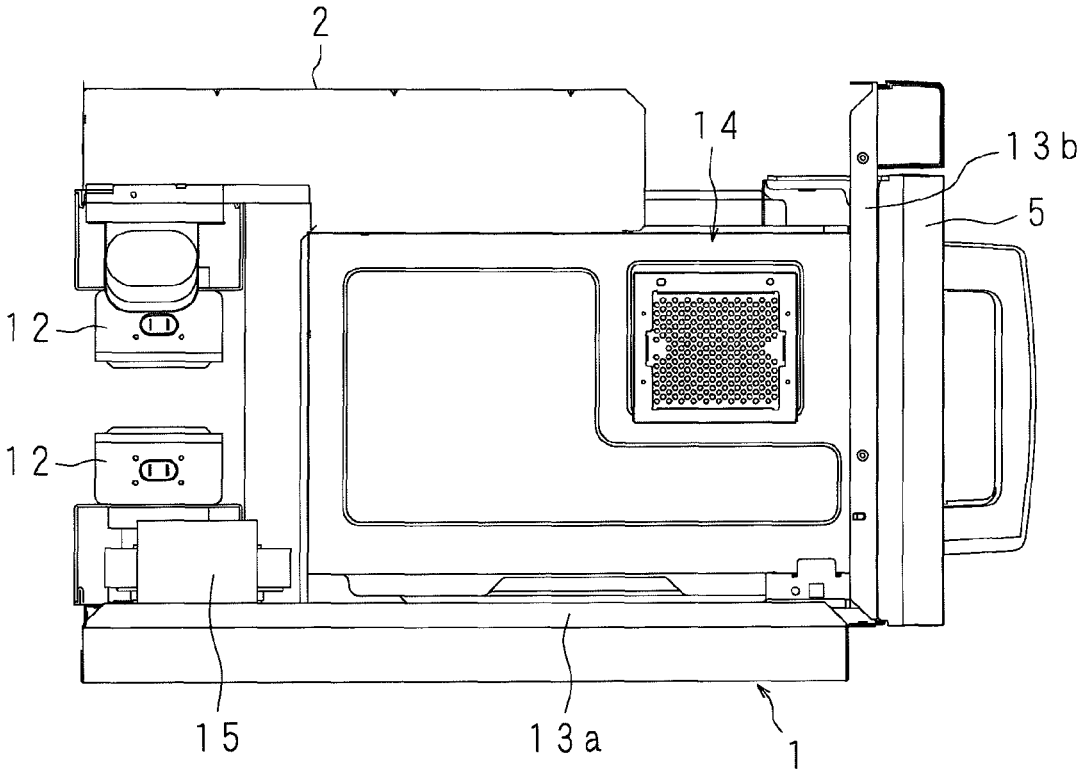
FIG. 7 is a partly omitted left side view showing the structure of the cooking device according to the present invention.
Figure 8:
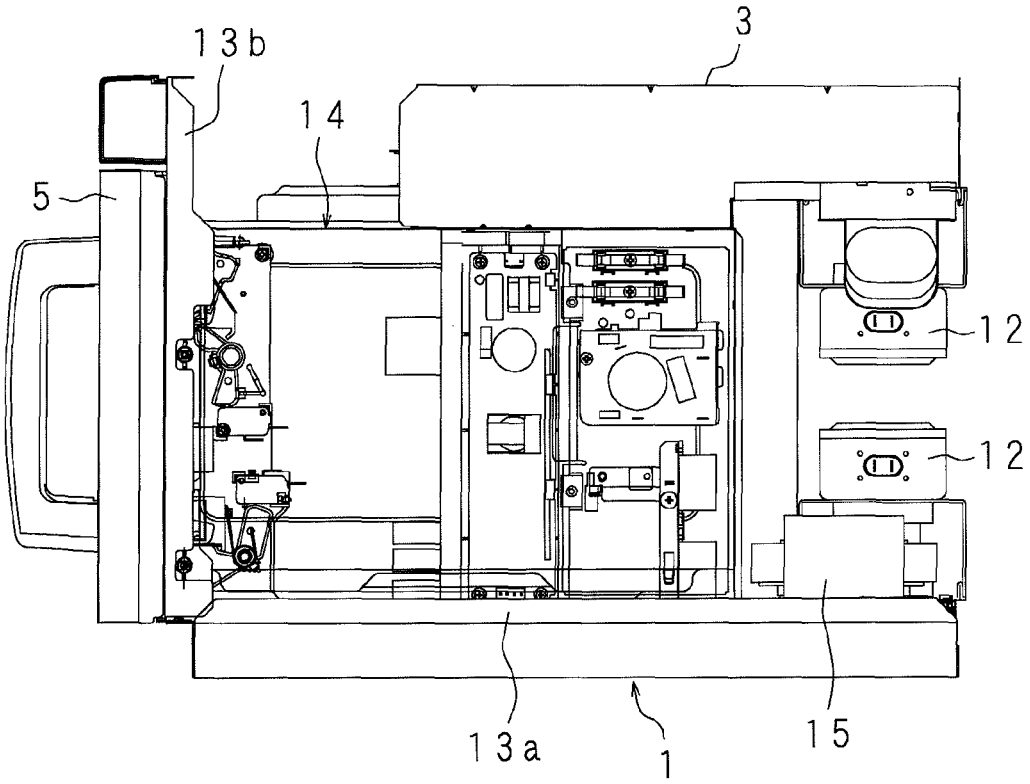
FIG. 8 is a partly omitted right side view showing the structure of the cooking device according to the present invention.
Figure 9:
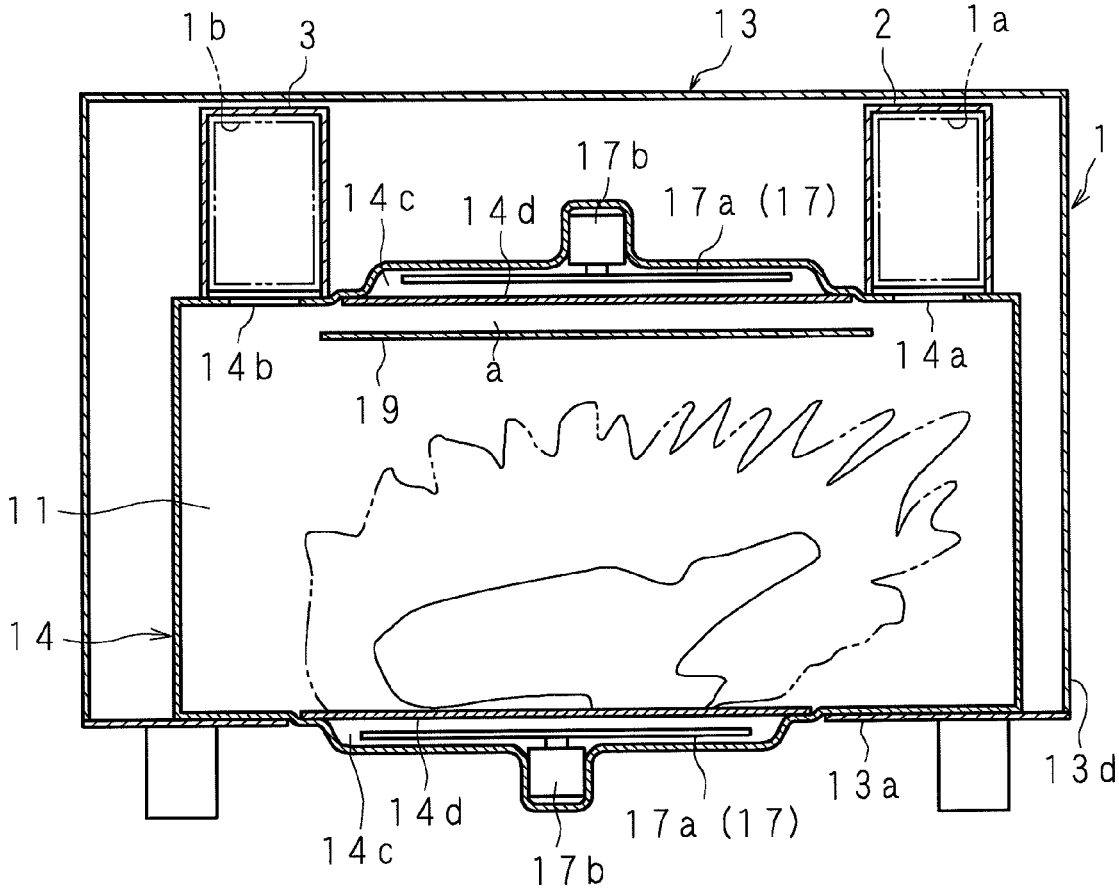
FIG. 9 is a schematic cross sectional view showing the structure of the cooking device according to the present invention.

FIG. 1 is a schematic perspective view showing the structure of a cooking device according to the present invention, FIG. 2 and FIG. 3 are partly omitted rear perspective view showing the structure of the cooking device, FIG. 4 is a front view showing the structure of the cooking device, FIG. 5 is a partly omitted plan view showing the structure of the cooking device, FIG. 6 is a partly omitted rear view showing the structure of the cooking device, FIG. 7 is a partly omitted left side view showing the structure of the cooking device, FIG. 8 is a partly omitted right side view showing the structure of the cooking device, and FIG. 9 is a schematic cross sectional view showing the structure of the cooking device.

The cooking device shown in FIG. 1 is a microwave oven for heating an object by electromagnetic waves, and comprises a substantially rectangular parallelepiped cooking device body 1 including a heating chamber 11 for heating an object on the front side and an electromagnetic generating unit 12 behind the heating chamber 11; an exhaust duct 2, provided on one side of the top of the heating chamber 11, for guiding air in the heating chamber 11 to the outside of the cooking device body 1; an air supply duct 3, provided on the other side of the top of the heating chamber 11, for supplying outside air into the heating chamber 11; and a fan 4 for discharging the air in the heating chamber 11 into the exhaust duct 2.

The cooking device body 1 has a substantially rectangular parallelepiped shape, and comprises a cabinet 13 having an opening on the front side of the heating chamber 11; a door body 5 for closing motion of the opening on the front side; a housing 14 which is placed on the front side in the cabinet 13 and includes the heating chamber 11; two electromagnetic generating units 12, 12, two transformers 15, 15 and two cooling fans 16, 16 disposed behind the housing 14; electromagnetic supply units 17, disposed on the upper side and lower side of the housing 14, for supplying electromagnetic waves generated by the electromagnetic generating units 12, 12 to the heating chamber 11; a control unit for controlling electric parts such as the electromagnetic generating units 12, 12; and an operation section for operating the control unit.

The cabinet 13 is composed of a quadrangular base 13*a*, a front frame 13*b* having an opening and joined to the front edge of the base 13*a*, a rear frame 13*c* mounted to the rear edge of the base 13*a*, and a substantially inverted U-shaped cover body 13*d* including two side plates and a top plate, and has the housing 14 mounted on the front side of the base 13*a*. A door body is supported to swing on one side of the opening of the front frame 13*b*.

A support plate 18 is mounted on the rear side of the base 13*a*, and the electromagnetic generating units 12, 12, the transformers 15, 15, and the cooling fans 16, 16 are respectively attached to the support plate 18 and the base 13*a*. The electromagnetic generating units 12 and 12 are composed of magnetrons. The electromagnetic supply unit 17 having a radial salient comprises a rotary antenna 17*a*, and a motor 17*b* for driving the rotary antenna 17*a*.

A grille-shaped exhaust port 1*a* is connected to an exit end of the exhaust duct 2, and provided in the top of the rear frame 13*c* on one side. A grille-shaped intake port 1*b* is connected to an entrance end of the air supply duct 3, and provided in the top on the other side.

The housing 14 has a substantially rectangular parallelepiped shape with an opening in its front side, and includes an exhaust port 14*a* on one side of a top plate and a supply port 14*b* on the other side. The exhaust port 14*a* and the supply port 14*b* are composed of a plurality of small holes. Circular recesses 14*c* are formed in the center of the top plate and a base plate. The electromagnetic supply unit 17 is placed in each recess 14*c*. In addition, each recess 14*c* provides a lid plate 14*d* to close the opening of each recess 14*c* and a sensor 6 to detect driving and stopping of the rotary antenna 17*a*. Moreover, a shield plate 19 is provided in the upper section of the heating chamber 11, and positioned under the top plate that includes the lid plate 14*d*, followed by forming a ventilation path between the top plate and itself.

Figure 10:
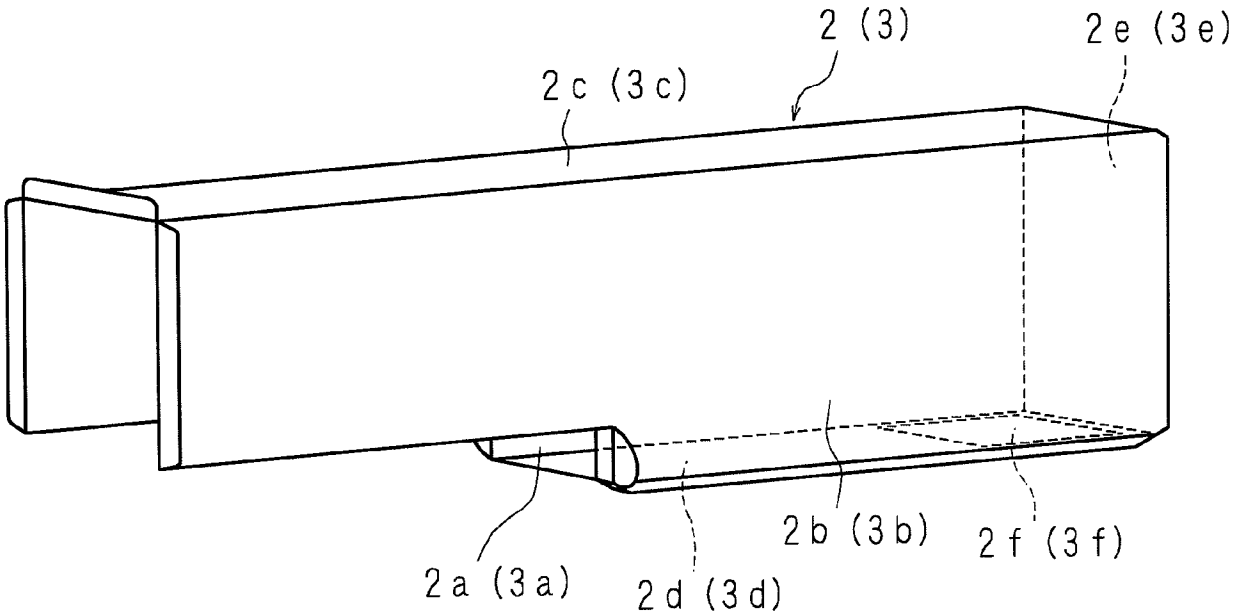
FIG. 10 is a perspective view showing the structure of an exhaust duct in the cooking device according to the present invention.

FIG. 10 is a perspective view showing the structure of the exhaust duct 2. The exhaust duct 2 and the air supply duct 3 are formed in the shape of square pipes of the same size, including two side plates 2*a*, 2*b*, 3*a*, 3*b*, top plates 2*c*, 3*c*, base plates 2*d*, 3*d*, and end plates 2*e* 3*e* at one end. The exhaust duct 2 has an inlet 2*f* corresponding to the exhaust outlet 14*a* in the base plate 2*d* of the exhaust duct 2. The air supply duct 3 has an outlet 3*f* corresponding to the supply port 14*b* in the base plate 3*d* of the air supply duct 3. The inside of the exhaust duct 2 forms an exhaust guide plane 22 for guiding the exhaust air blown by the fan 4 into the exhaust port 1*a*, while the inside of the air supply duct 3 forms an intake guide plane for guiding outside air drawn from the intake port 1*b* to the supply port 14*b*.

The exhaust duct 2 is placed in the front-to-rear direction on one side of the top plate of the housing 14, and the air supply duct 3 is placed on the other side. The lower edges of both side plates 2*a*, 2*b*, 3*a*, 3*b* are mounted to the top plate. In addition, the exhaust duct 2 has the end plate 2*e* on the exhaust port 14*a* side, while the air supply duct 3 has the end plate 3*e* on the supply port 14*b* side.

After the formation of the exhaust duct 2 in the same shape as the air supply duct 3, the exhaust duct 2 is formed to provide, in one side plate 2*a* on the entrance side, a plurality of screw holes and a through hole 21*a* that passes, to insert a bladed wheel, through in a direction crossing the air guiding direction of the exhaust guide plane 22. The through hole 21 has a larger diameter than a bladed wheel 41 of the fan 4. In addition, the exhaust duct 2 provides a casing 42, at the inside of the entrance side of the exhaust duct 2, that encases the bladed wheel 41.

Figure 11:
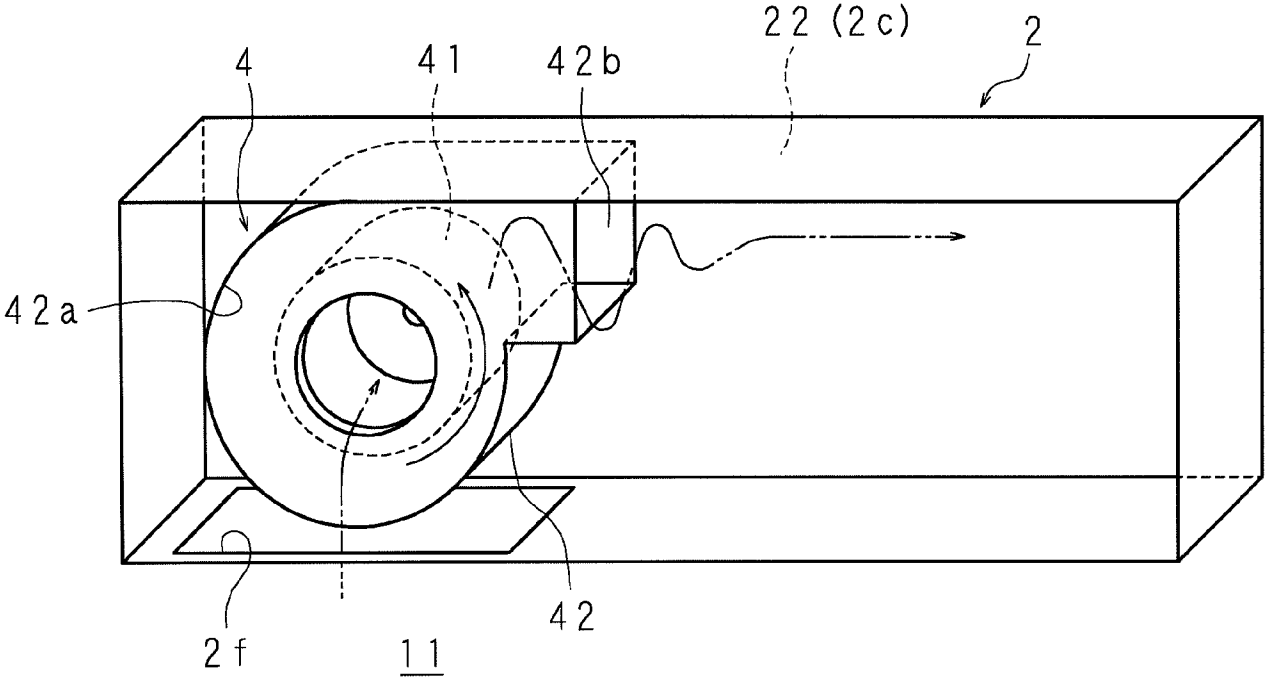
FIG. 11 is a schematic perspective view showing the relationship between a fan and the exhaust duct in the cooking device according to the present invention.
Figure 12:
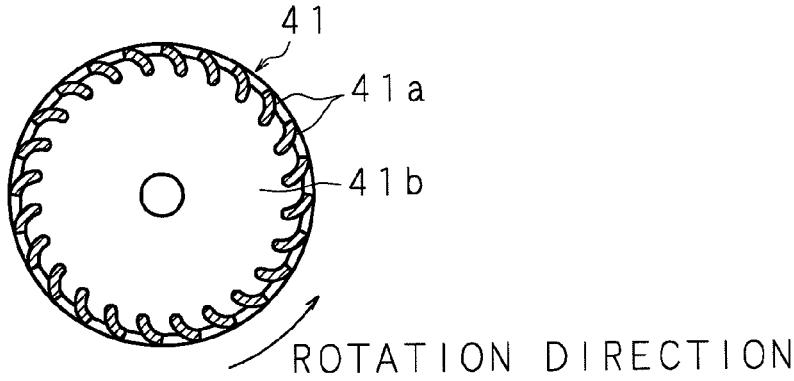
FIG. 12 is a cross sectional view showing the structure of a bladed wheel in the cooking device according to the present invention.

FIG. 11 is a schematic perspective view showing the relationship between the fan 4 and the exhaust duct 2, and FIG. 12 is a cross sectional view showing the structure of the bladed wheel. The fan 4 includes the cylindrical-shaped bladed wheel 41 and the casing 42 that holds the bladed wheel 41 in a rotatable manner. A motor 7 is mounted outside the exhaust duct 2 on the periphery of the through hole 21 in the side plate 2*a* for driving the bladed wheel 41, and the casing 42 is mounted in the exhaust duct 2 with a plurality of screws.

The bladed wheel 41 is a multiblade bladed wheel which provides a plurality of blades 41a. In the blades 41a, each edge at rotation center side is kept rearward in the rotation direction with respect to each outside edge. In other words, this bladed wheel 41 is a cylindrical sirocco bladed wheel. While the bladed wheel 41 has a bearing plate 41*b* at one end and an output shaft of the motor 7 mounted in a shaft hole formed in the center of the bearing plate 41*b*, the bladed wheel 41 is configured to discharge, from between the blades 41*a* on the outer circumference, sucked air from the opening at the other end into an air hole in the center.

The casing 42 has an arc-shaped guide plane 42*a* for guiding, 41 in the rotation direction of the bladed wheel 41, an air flow that is generated by a rotation of the bladed wheel, and an outlet port 42*b* opened from a part of the arc-shaped guide plane 42*a* to one side in a tangent direction of the arc-shaped guide plane 42*a*. In addition, the casing 42 is configured to decenter the center of the bladed wheel 41 toward the outlet port 42*b* with respect to the center of the arc-shaped guide plane 42*a*. The bladed wheel 41 is allowed to rotate in a direction opposite to the opening direction of the outlet port 42*b*.

The outlet port 42*b* is in the shape of a rectangular sectioned pipe that projects from a part of the arc-shaped guide plane 42*a* toward one side in a tangent direction of the arc-shaped guide plane 42*a*. In the outlet port 42*b*, one plane connected to the arc-shaped guide plane 42*a* is parallel to the exhaust guide plane 22 of the top plate 2*c*.

The cooking device described above is used, for example, on a mount base. In this cooking device, the control unit operates to electrify magnetron (electromagnetic generating units 12) by controlling the operation section. Then, electromagnetic waves are supplied to the heating chamber 11 from the electromagnetic supply units 17 that are placed on the top and bottom of the heating chamber 11. Accordingly, an object in the heating chamber 11 is heated and cooked. In addition, the bladed wheel 41 and the cooling fans 16 are driven.

By driving the bladed wheel 41, the air in the heating chamber 11 is sucked into the casing 42 from the exhaust port 14*a* of the housing 14, and the internal pressure in the heating chamber 11 is decreased. Accordingly, the intake port 1*b* sucks external air into the air supply duct 3, and then the supply port 14*b* supplies the air into the heating chamber 11 through the air supply duct 3.

The bladed wheel 41 of the fan 4 rotates in the direction opposite to the opening direction of the outlet port 42*b* as shown by the arrow in FIG. 11. Therefore, the rotation of the bladed wheel 41 makes the air flow generated along the arc-shaped guide plane 42*a* strike on the inner surface of the outlet port 42*b*. As a result, the air flow becomes vortex turbulence oscillating up and down in the exhaust duct 2 and is discharged along the exhaust guide plane 22 from the exhaust port 1*a*.

Accordingly, air that becomes an air flow by the rotation of the bladed wheel 41 is blown in a direction crossing the opening direction of the outlet port 42*b*, but not in a direction parallel to the opening direction of the outlet port 42*b*, and becomes turbulence near the outlet port 42*b*. Even if the object ignites in the heating chamber 11 during cooking and the flames are sucked into the casing 42, air containing the flames becomes vortex turbulence and catches up air around the flames. Consequently, the flames are cooled down. Therefore, it is possible to extinguish the flames within a relatively short distance, and to prevent the flames from reaching to the exhaust port la. Hence, it is possible to shorten the entire length of the exhaust duct 2 and reduce the size of the cooking device, without providing a flame damper material in the exhaust duct 2.

(Embodiment 2)

Figure 13:
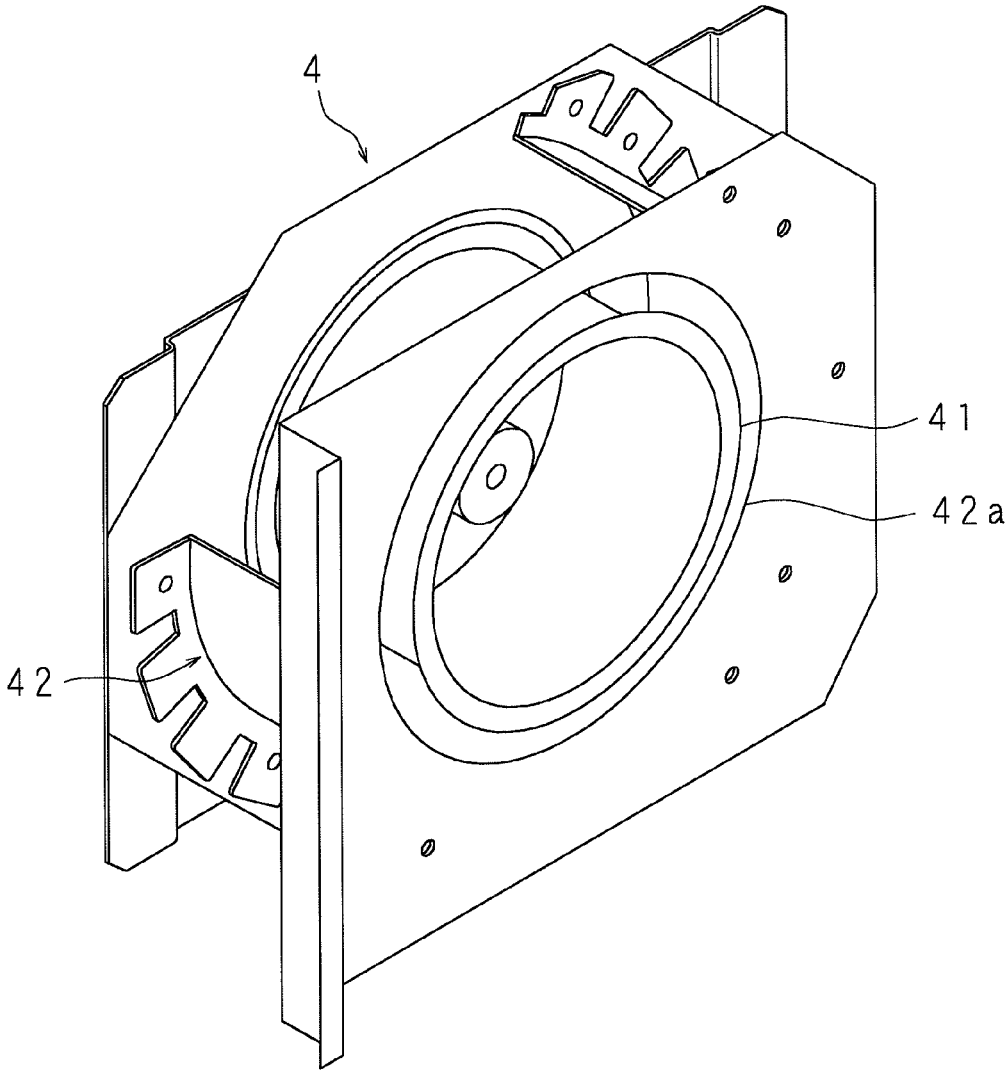
FIG. 13 is a partly omitted perspective view showing another structure of the fan in the cooking device according to the present invention.
Figure 14:
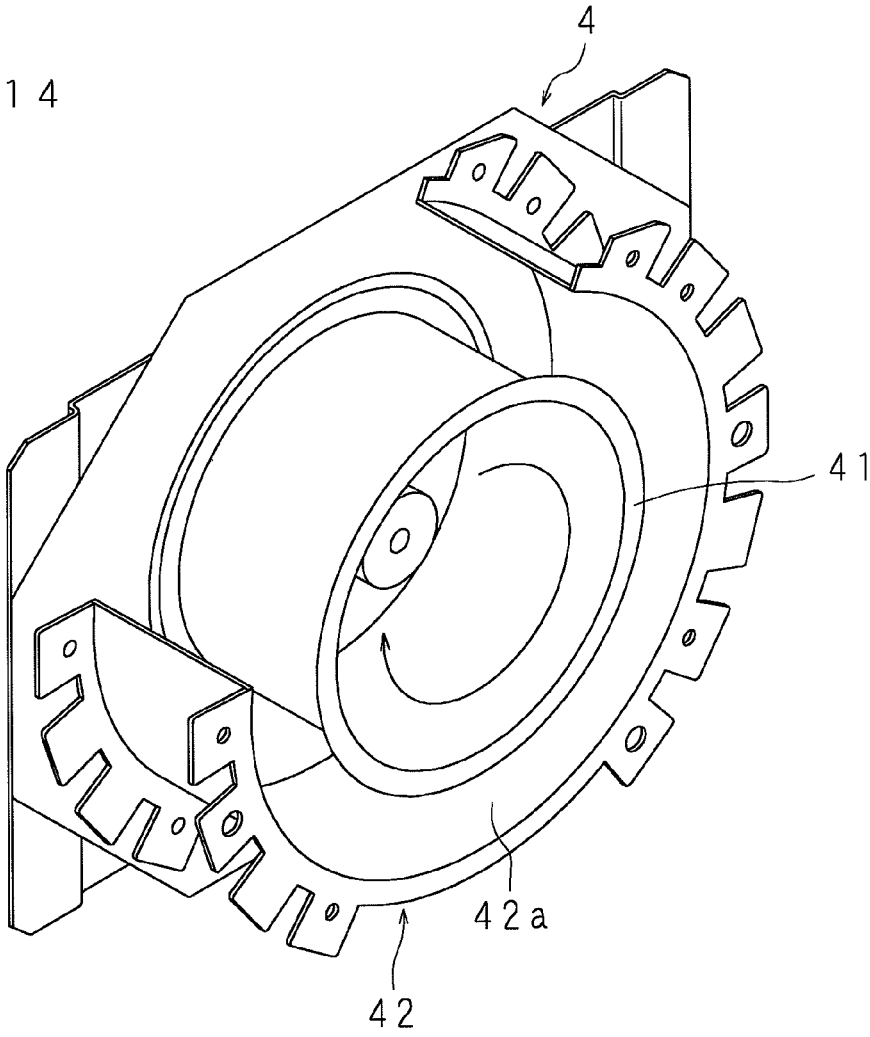
FIG. 14 is a perspective view showing other structure of the fan in the cooking device according to the present invention.
Figure 15:
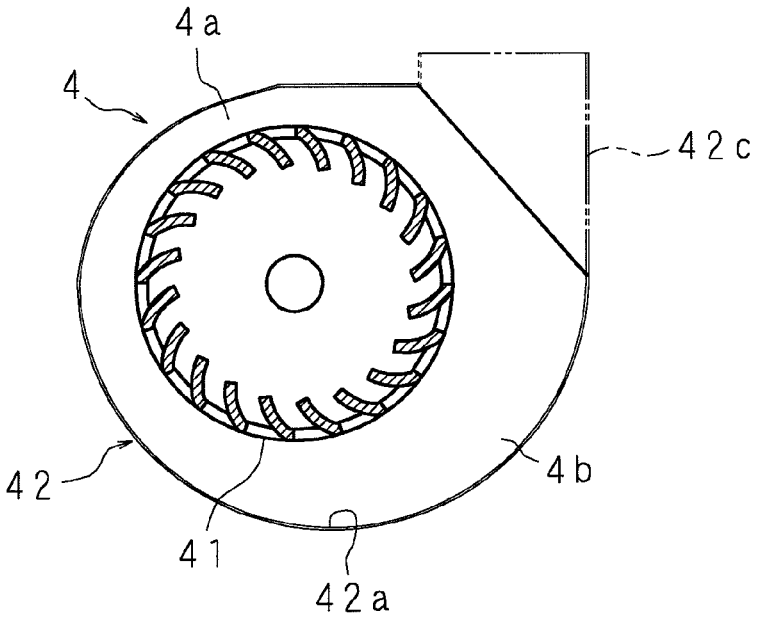
FIG. 15 is a schematic view showing another structure of a casing in the cooking device according to the present invention.
Figure 16A:
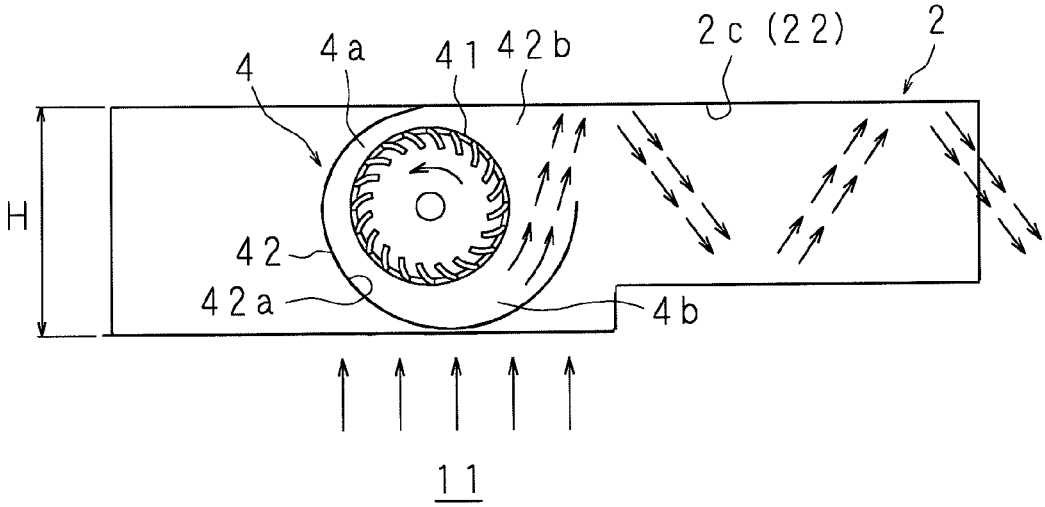
FIG. 16A is a schematic side view showing the relationship between the fan and the exhaust duct in the cooking device according to the present invention.
Figure 16B:
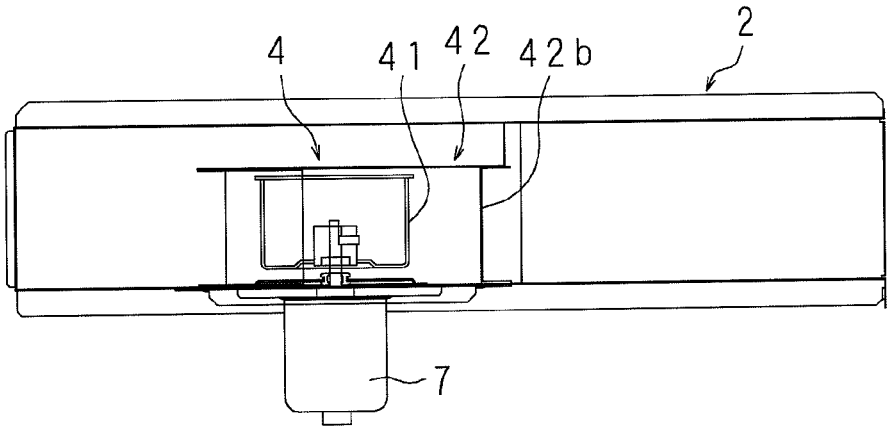
FIG. 16B is a schematic cross sectional view of the same.

FIG. 13 is a partly omitted perspective view showing another structure of the fan 4 in the cooking device, FIG. 14 is a perspective view showing other structure of the fan 4, FIG. 15 is a schematic view showing another structure of the casing 42, and FIG. 16A and FIG. 16B are a schematic side view and a schematic cross sectional view, respectively, showing the relationship between the fan 4 and the exhaust duct 2.

The cooking device according to Embodiment 1 provides an arc-shaped guide plane 42*a* and a rectangular sectioned pipe section 42*c*, whose inside constitutes the outlet port 42*b*, that projects from a part of the arc-shaped guide plane 42*a* to one side in a tangent direction of the arc-shaped guide plane 42*a*. The cooking device according to Embodiment 2 lacks the square pipe section 42*c*. In the cooking device according to Embodiment 2, the lacked opening is utilized as the outlet port 42*b*, and the casing 42 is arranged to blow air from the outlet port 42*b*, by the rotation of the bladed wheel 41, in a direction crossing the exhaust guide plane 22 of the top plate 2*c*.

In this Embodiment 2, the bladed wheel 41 is decentered with respect to the center of the arc-shaped guide plane 42*a*. A guide path is configured to change gradually from a narrow guide path 4*a* to a wide guide path 4*b*, between the circumferential surface of the bladed wheel 41 and the arc-shaped guide plane 42*a*. Consequently, the casing 42 is arranged in the exhaust duct 2 to keep the narrow guide path 4*a* close to the top plate 2*c* and the wide guide path 4*b* distant from the top plate 2*c* in the outlet port 42*b*. The bladed wheel 41 is configured in the same manner as in Embodiment 1, and rotates in the direction shown by the arrow in FIG. 16A.

In this embodiment, the bladed wheel 41 rotates in the opening direction of the outlet port 42*b* as shown by the arrow in FIG. 16A, an air flow generated by a rotation of the bladed wheel 41 strikes on the exhaust guide plane 22 of the top plate 2*c*. Therefore, the air flow becomes vortex turbulence oscillating up and down. Then, the air flow is blown into the exhaust duct 2 and discharged along the exhaust guide plane 22 from the exhaust port 1*a*.

Figure 17A:
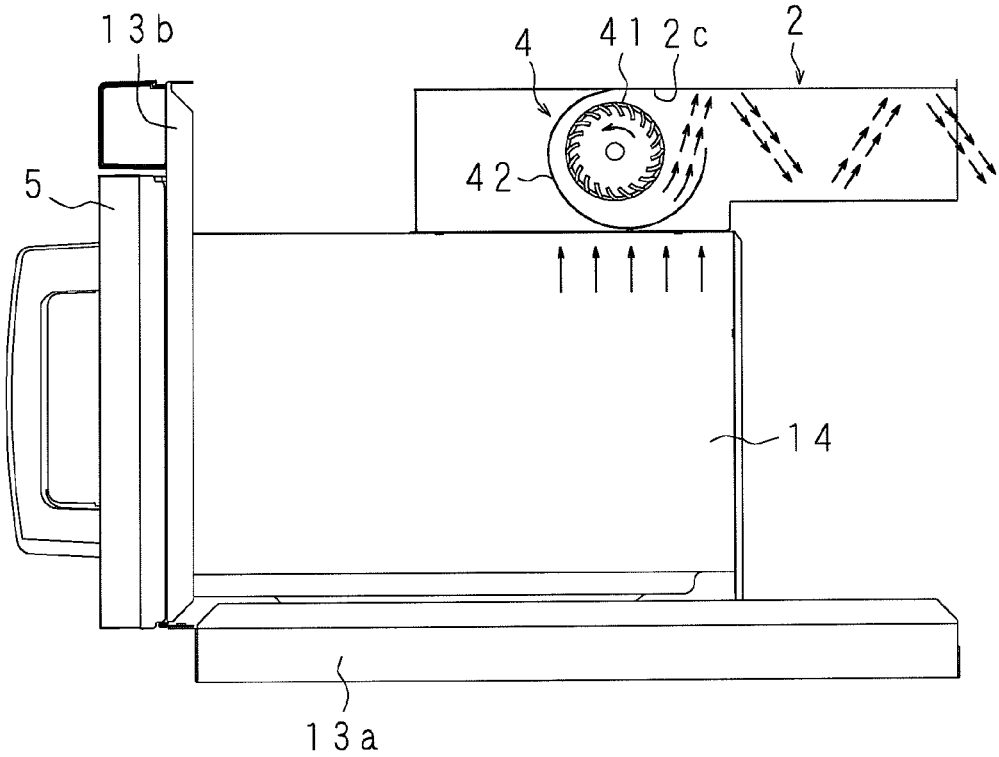
FIG. 17A is a schematic side view of the cooking device according to the present invention.
Figure 17B:
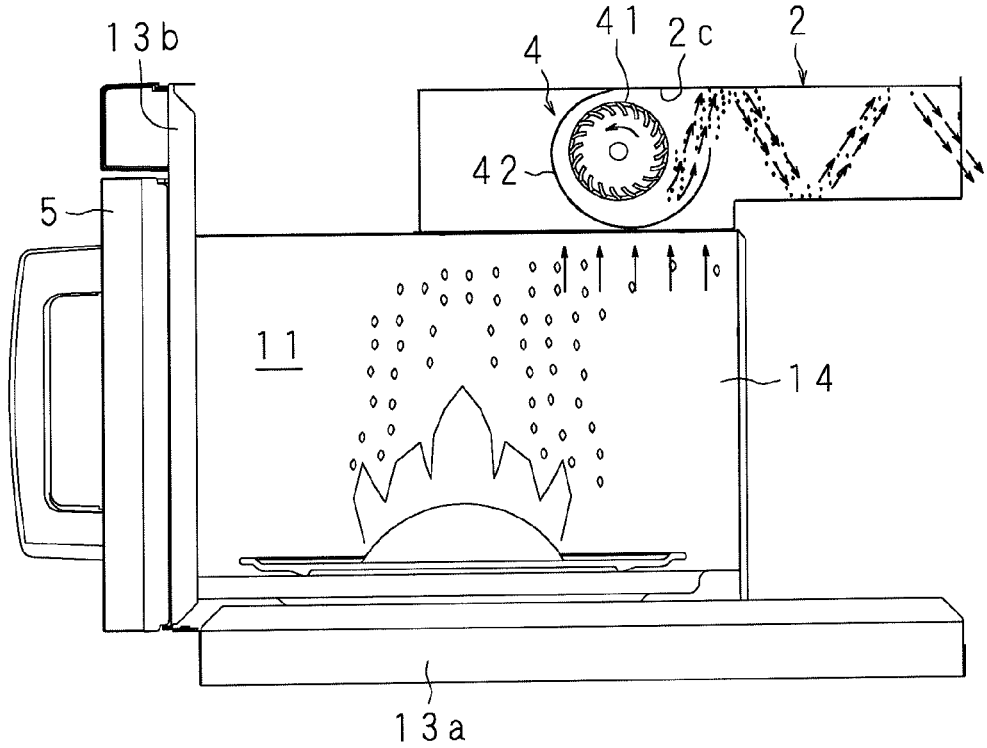
FIG. 17B is a schematic side view of the same when an object is burning.
Figure 18A:
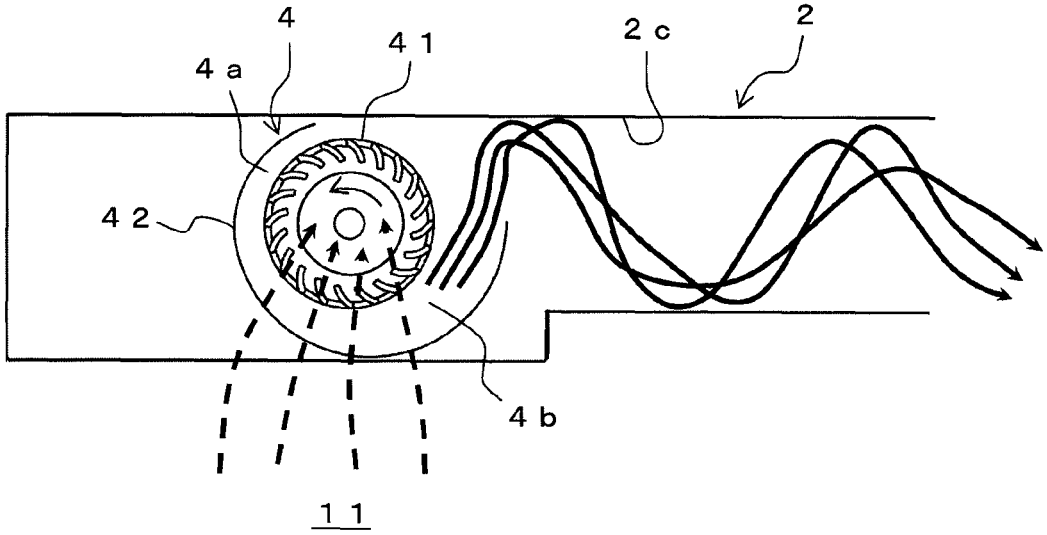
FIG. 18A and FIG. 18B are conceptual views showing an air flow generated by driving the fan in the cooking device according to the present invention.
Figure 18B:
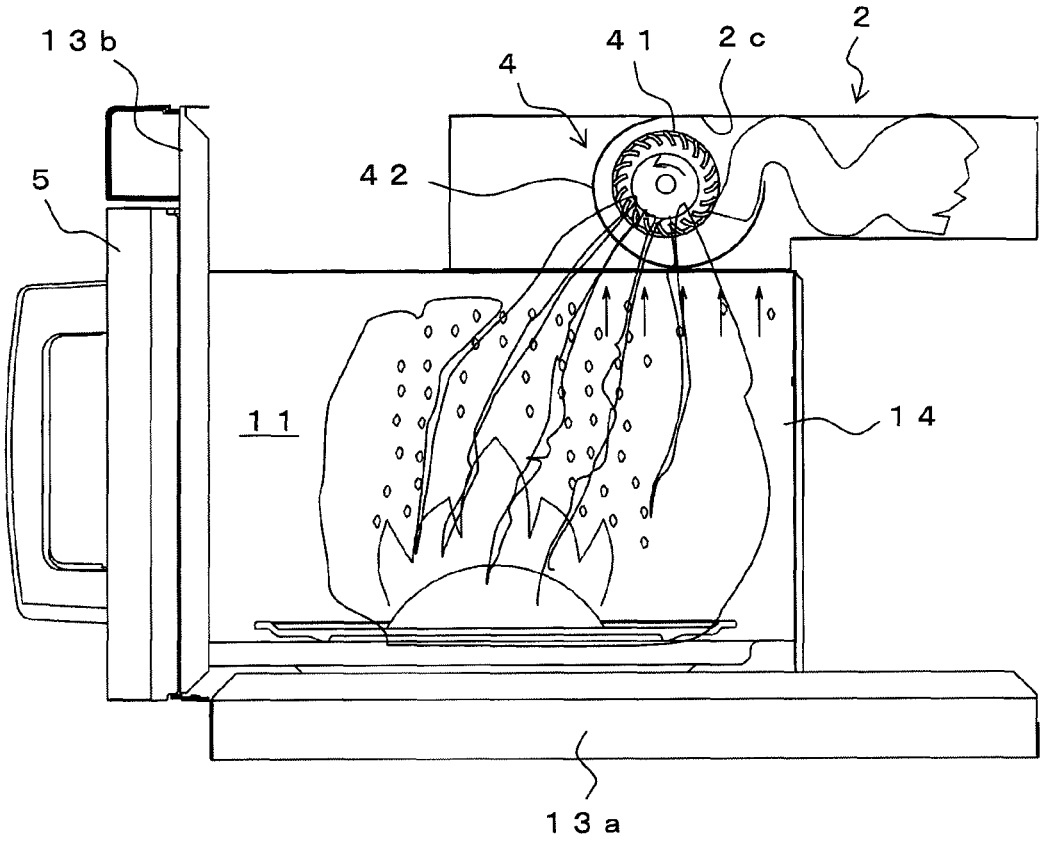

FIG. 17A is a schematic side view of the cooking device, FIG. 17B is a side view of the same when an object is burning, and FIG. 18A and FIG. 18B are conceptual views showing an air flow generated by driving the fan. The air that becomes an air flow by a rotation of the bladed wheel 41 is blown in a direction crossing the opening direction of the outlet port 42*b*, but not in a direction parallel to the opening direction of the outlet port 42*b*. Consequently, the air flow becomes vortex turbulence near the outlet port 42*b*. Therefore, even if an object ignites in the heating chamber 11 during cooking and the flames are sucked into the casing 42, the air containing the flames becomes vortex turbulence and catches up air around the flames. Consequently, the flames are cooled down. Thus, it is possible to extinguish the flames within a relatively short distance, and it is possible to prevent the flames from reaching to the exhaust port 1*a*. Hence, it is possible to shorten the entire length of the exhaust duct 2 and reduce the size of the cooking device, without providing a flame damper material in the exhaust duct 2.

Figure 19:
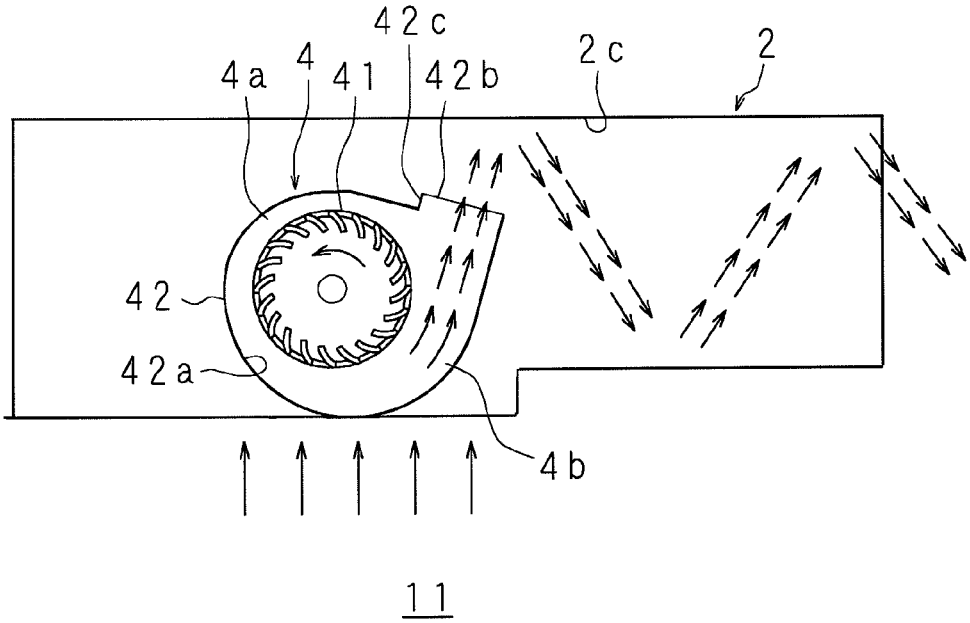
FIG. 19 is a schematic side view showing the relationship between the exhaust duct and a fan including a casing with a square pipe section.

FIG. 19 is a schematic side view showing the relationship between the exhaust duct 2 and the fan 4 that provides the casing 42 including the square pipe section 42*c*. Because the casing 42 according to Embodiment 2 lacks the rectangular sectioned pipe section 42*c* that projecting from a part of the arc-shaped guide plane 42*a* to one side in the tangent direction of the arc-shaped guide plane 42*a* and utilizes the lacked opening as the outlet port 42*b*, it is possible to make a height H of the exhaust duct 2 relatively lower as shown in FIG. 16A when compared to the casing 42 including the square pipe section 42*c* shown in FIG. 19. Accordingly, it is possible to decrease the height of the cooking device on a mount base at a higher position from the floor surface and to improve operability of a door body and an operation panel, because the height of the cooking device can be decreased in comparison with the cooking device that provides the casing 42 including the square pipe section 42*c*.

(Embodiment 3)

Figure 20:
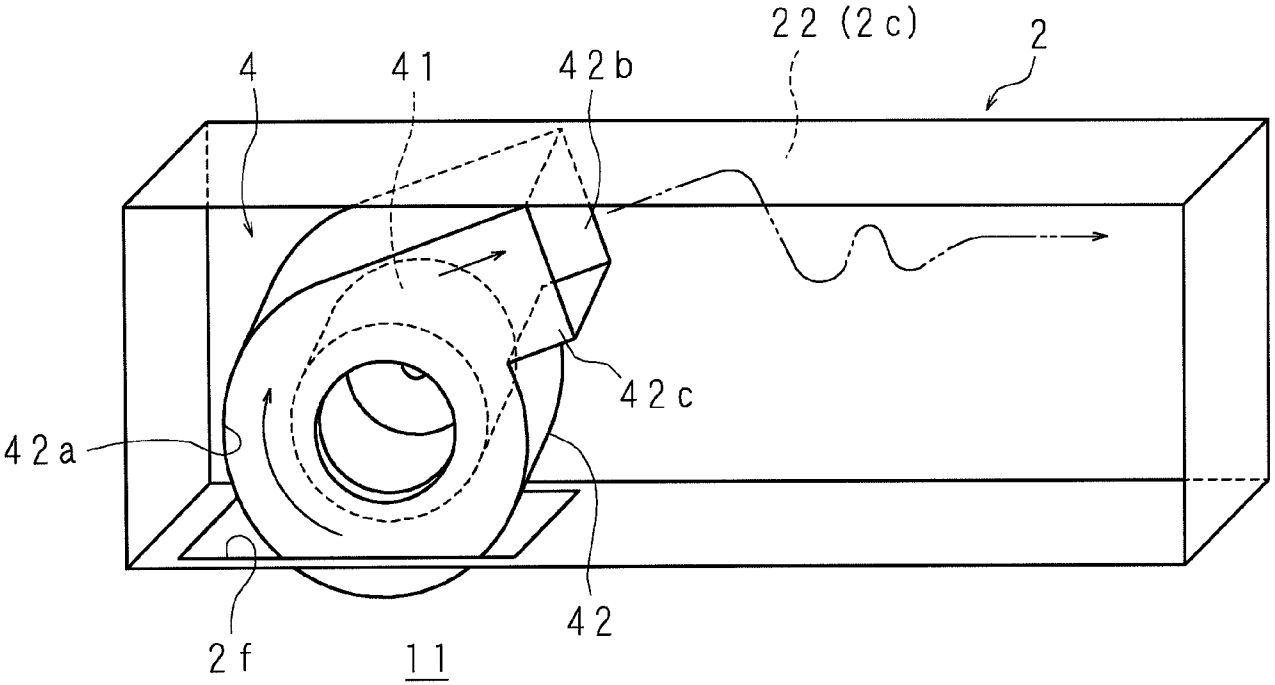
FIG. 20 is a schematic perspective view of essential sections showing other structure of the cooking device according to the present invention.
Figure 21:
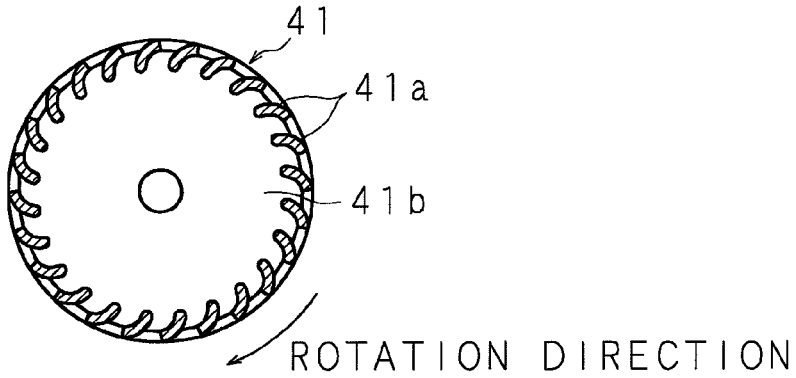
FIG. 21 is a cross sectional view showing other structure of the bladed wheel in the cooking device according to the present invention.

FIG. 20 is a schematic perspective view of essential sections showing other structure of the cooking device, and FIG. 21 is a cross sectional view showing other structure of the bladed wheel. The cooking device according to Embodiment 3 comprises a casing 42 that includes an arc-shaped guide plane 42*a* and a square pipe section 42*a* projecting from a part of the arc-shaped guide plane 42*a* to one side in a tangent direction of the arc-shaped guide plane 42*a*. In the cooking device, the inside of the square pipe section 42*c* is utilized as an outlet port 42*b*. The casing 42 is obliquely arranged to keep the blowing direction in the outlet port 42*b* across the exhaust guide plane 22 of the exhaust duct 2 at a suitable angle, and to make the air blown from the outlet port 42*b* into the exhaust duct 2 strike on the exhaust guide plane 22.

In this Embodiment 3, the casing 42 is kept in the exhaust duct 2 similar to that of Embodiment 1. Thus, the wide guide path 4*b* is close to the top plate 2*c* and the narrow guide path 4*b* is distant from the top plate 2*c* in the square pipe section 42*c*. In other words, the casing 42 is arranged in the exhaust duct 2, so that the narrow guide path 4*a* is closer to the exhaust port 1*a* than the wide guide path 4*b* in the square pipe section 42*c*, one plane of the square pipe section 42*c* connected linearly to the arc-shaped guide plane 42*a* of the wide guide path 4*a* in the blowing direction is located on the top plate 2*c* side, and the blowing direction in the outlet port 42*b* crosses the exhaust guide plane 22 of the exhaust duct 2.

The bladed wheel 41 is a multiblade bladed wheel which provides a plurality of blades 41*a*. In the blades 41*a*, each edge at rotation center side is kept rearward in the rotation direction with respect to each outside edge. In other words, this bladed wheel 41 is a cylindrical sirocco bladed wheel. It is configured to rotate the air flow, which is guided by the arc-shaped guide plane 42*a*, in the opening direction of the outlet port 42*b* (to one side in the tangent direction).

In this embodiment, the bladed wheel 41 of the fan 4 rotates in the opening direction of the outlet port 42*b* as shown by the arrow in FIG. 20. Then, an air flow generated by a rotation of the bladed wheel 41 is blown into the exhaust duct 2 along one plane of the outlet port 42*b* that is connected to the arc-shaped guide plane 42*a*. Therefore, the blown air flow strikes on the exhaust guide plane 22 of the top plate 2*c*, and becomes vortex turbulence oscillating up and down. Consequently, the air flow is guided to the exit side of the exhaust duct 2 and discharged from the exhaust port 1*a* to the outside.

Thus, it is possible to make vortex turbulence in the exhaust duct 2 for the air blown from the outlet port 42*b* of the fan 4 that includes the bladed wheel 41 rotating in the opening direction of the outlet port 42*b*. Even if the object ignites in the heating chamber 11 during cooking and the flames are sucked into the casing 42, air containing the flames becomes vortex turbulence and catches up air around the flames. Consequently, the flames are cooled down. Therefore, it is possible to extinguish the flames within a relatively short distance, and to prevent the flames from reaching to the exhaust port 1*a*. Hence, it is possible to shorten the entire length of the exhaust duct 2 and reduce the size of the cooking device, without providing a flame damper material in the exhaust duct 2.

(Embodiment 4)

Figure 22:
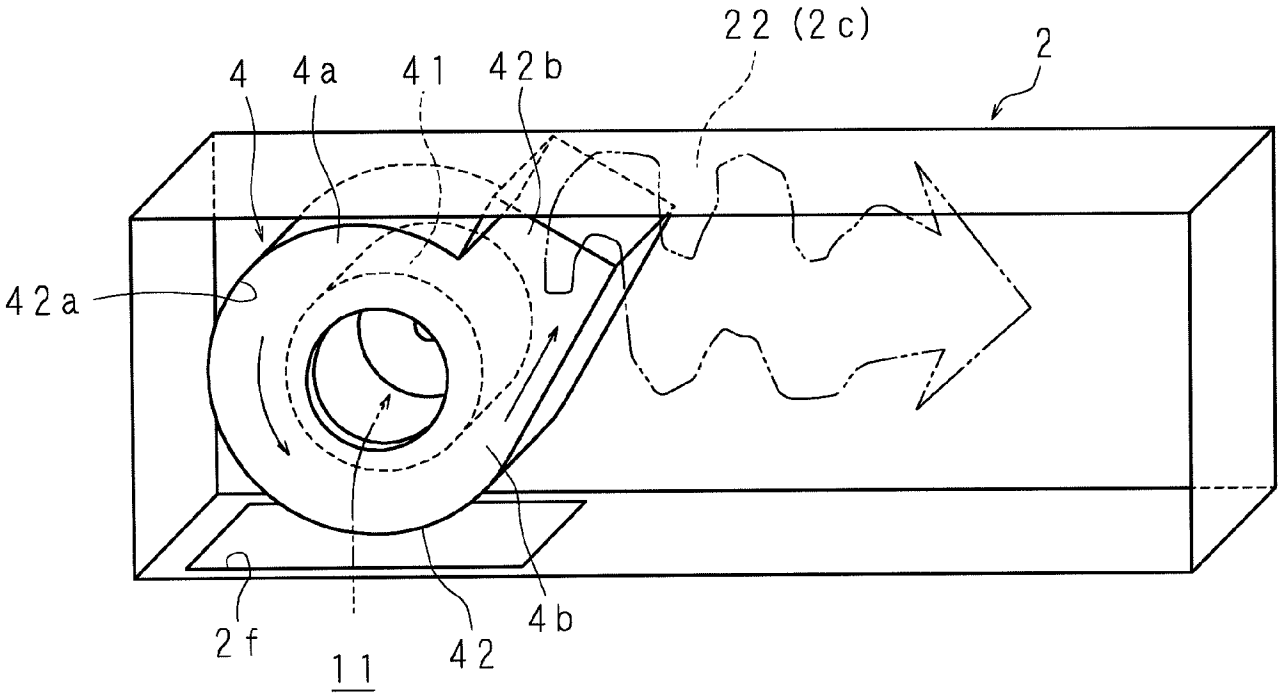
FIG. 22 is a schematic perspective view of essential sections showing other structure of the cooking device according to the present invention.

FIG. 22 is a schematic perspective view of essential sections showing other structure of the cooking device. This cooking device comprises the casing 42 that includes an arc-shaped guide plane 42*a* and a rectangular sectioned pipe section 42*c* projecting from a part of the arc-shaped guide plane 42*a* to one side in a tangent direction of the arc-shaped guide plane 42*a*. The inside of the rectangular sectioned pipe section 42*c* is utilized as an outlet port 42*b*. The casing 42 is configured in the exhaust duct 2 to keep the wide guide path 4*b* closer to the exhaust port 1*a* than the narrow guide path 4*a* in the rectangular sectioned pipe section 42*c*, to keep at the exhaust port 1*a* side one plane of the rectangular sectioned pipe section 42*c* connected linearly to the arc-shaped guide plane 42*a* of the wide guide path 4*b* in the blowing direction, and to keep the blowing direction in the exhaust port 1*a* across the exhaust guide plane 22 of the exhaust duct 2.

In this Embodiment 4, the bladed wheel 41 is a multiblade bladed wheel which provides a plurality of blades 41*a*. In the blades 41*a*, each edge at rotation center side is kept rearward in the rotation direction with respect to each outside edge. In other words, this bladed wheel 41 is a cylindrical sirocco bladed wheel. It is configured to rotate the air flow, which is guided by the arc-shaped guide plane 42*a*, in the opening direction of the outlet port 42*b* (to one side in the tangent direction).

In this embodiment, the bladed wheel 41 rotates in the opening direction of the outlet port 42*b* as shown by the arrow in FIG. 22. Therefore, an air flow generated by a rotation of the bladed wheel 41 strikes on the exhaust guide plane 22 of the top plate 2*c*, and becomes vortex turbulence oscillating up and down. Then, the air flow is blown into the exhaust duct 2 and discharged along the exhaust guide plane 22 from the exhaust port 1*a*.

Accordingly, air that becomes an air flow by the rotation of the bladed wheel 41 is blown in a direction crossing the opening direction of the outlet port 42*b*, but not directly in a direction parallel to the opening direction of the outlet port 42*b*, and becomes turbulence near the outlet port 42*b*. Even if the object ignites in the heating chamber 11 during cooking and the flames are sucked into the casing 42, air containing the flames becomes vortex turbulence and catches up air around the flames. Consequently, the flames are cooled down. Therefore, it is possible to extinguish the flames within a relatively short distance, and to prevent the flames from reaching to the exhaust port 1*a*. Hence, it is possible to shorten the entire length of the exhaust duct 2 and reduce the size of the cooking device, without providing a flame damper material in the exhaust duct 2.

(Embodiment 5)

Figure 23:
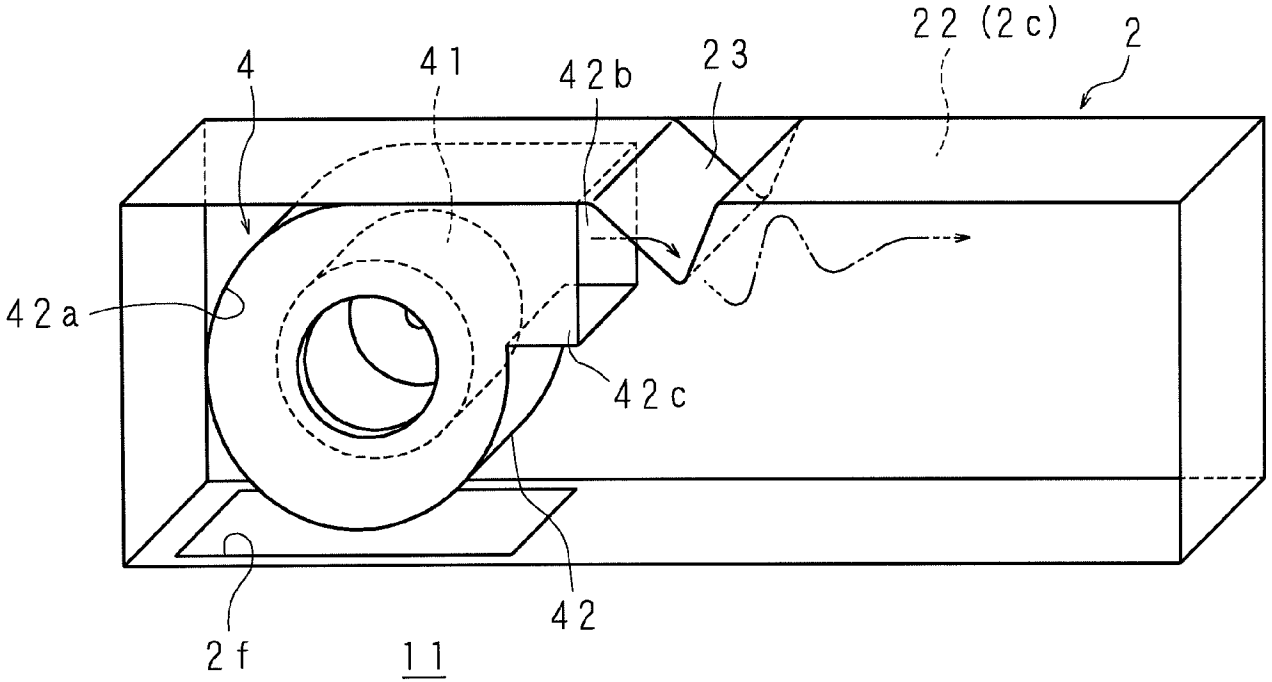
FIG. 23 is a schematic perspective view of essential sections showing other structure of the cooking device according to the present invention.
Figure 24:
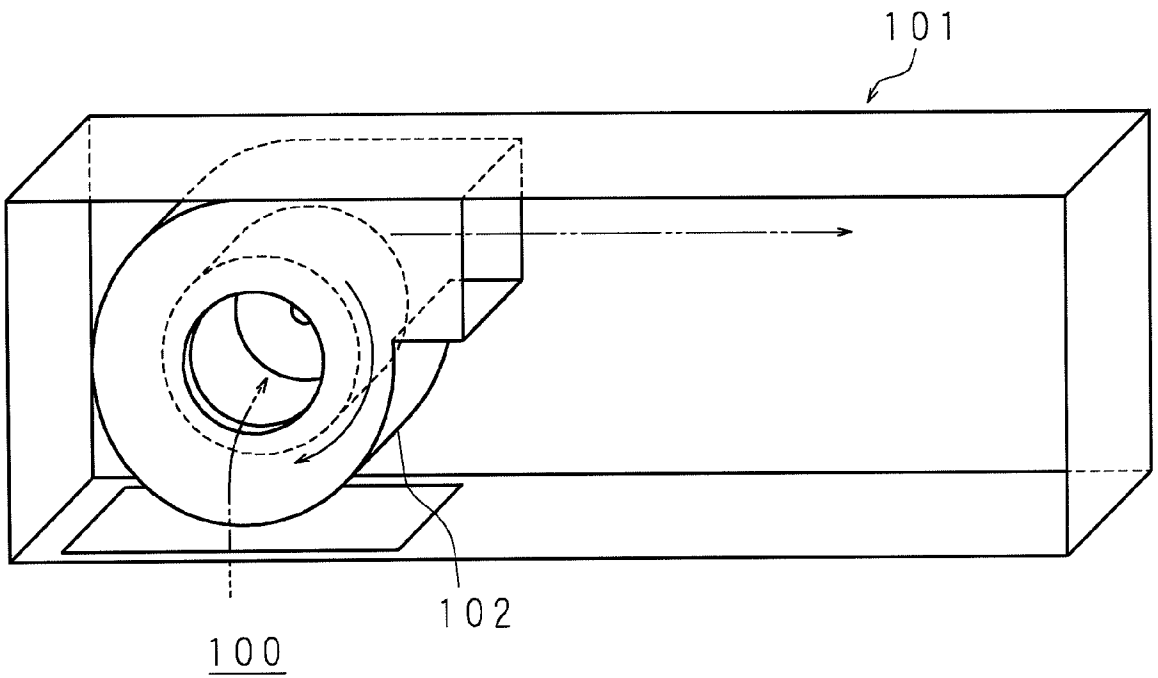
FIG. 24 PRIOR ART
FIG. 24 is a schematic perspective view showing the relationship between the fan and the exhaust duct in a cooking device previously developed by the applicant of the present invention.

FIG. 23 is a schematic perspective view of essential sections showing other structure of the cooking device. In Embodiments 3 and 4, the casing 42 is arranged in an inclined manner to keep the blowing direction in the outlet port 42*b* across the exhaust guide plane 22. Instead of inclined arrangement of the casing 42, the cooking device according to Embodiment 5 is configured to provide a projection 23, on the exhaust guide plane 22 near the outlet port 42*b*, across the opening direction of the outlet port 42*b* to strike on the air blown from the outlet port 42*b* into the exhaust duct 2.

In the embodiment 5, the casing 42 is configured in the same manner as in Embodiment 1. The bladed wheel 41 is a multiblade bladed wheel which provides a plurality of blades 41*a*. In the blades 41*a*, each edge at rotation center side is kept rearward in the rotation direction with respect to each outside edge. In other words, this bladed wheel 41 is a cylindrical sirocco bladed wheel. The center of the bladed wheel 41 is decentered toward the outlet port 42*b* with respect to the center of the arc-shaped guide plane 42*a*. The air flow guided by the arc-shaped guide plane 42*a* rotates in the opening direction of the outlet port 42*b*. The projection 23 is a part of the top plate 2*c* projecting inward, and inclined to the blowing direction.

In this Embodiment 5, the bladed wheel 41 of the fan 4 rotates in the opening direction of the outlet port 42*b* as shown by the arrow in FIG. 10, and the air flow generated by the rotation of the bladed wheel 41 is blown into the exhaust duct 2 along one plane of the outlet port 42*b* that is connected to the arc-shaped guide plane 42*a* and strikes on the projection 23 of the exhaust guide plane 22. Therefore, the air flow becomes vortex turbulence oscillating up and down. Then the air flow is guided to the exit side of the exhaust duct 2 and discharged from the exhaust port 1*a* to the outside.

Thus, it is possible to make vortex turbulence in the exhaust duct 2 for the air blown from the outlet port 42*b* of the fan 4 that includes the bladed wheel 41 rotating in the opening direction of the outlet port 42*b*. Even if the object ignites in the heating chamber 11 during cooking and the flames are sucked into the casing 42, air containing the flames becomes vortex turbulence and catches up air around the flames. Consequently, the flames are cooled down. Therefore, it is possible to extinguish the flames within a relatively short distance, and to prevent the flames from reaching to the exhaust port 1*a*. Hence, it is possible to shorten the entire length of the exhaust duct 2 and reduce the size of the cooking device, without providing a flame damper material in the exhaust duct 2.

Although the exhaust duct 2 and the air supply duct 3 are positioned on an upper side of the heating chamber 11 in the above-described embodiments, it may be possible to position at least one of the exhaust duct 2 and the air supply duct 3 on a lateral side of the heating chamber 11.

Moreover, although the above-described embodiments use the centrifugal fan 4 including the multi-blade bladed wheel 41, it may be possible to use a centrifugal fan 4 including a radial bladed wheel or a turbo bladed wheel, or use an axial flow fan. In the case where the axial flow fan is used, the axial flow fan is arranged to keep the blowing direction across the exhaust guide plane like Embodiments 3 and 4, or the axial flow fan is arranged in the exhaust duct 2 that provides the projection 23 in a part of the exhaust guide plane 22 like Embodiment 5. However, as mentioned above, if the driving motor of the fan is placed in the blowing duct, it is exposed to high-temperature exhaust. Therefore, it will be necessary to increase the resistance of the motor compared to a motor placed outside the blowing duct.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A cooking device, comprising:

a cooking device body having a heating chamber that heats an object;

a fan that discharges air of the heating chamber;

an exhaust duct that guides the air discharged from the heating chamber through an exhaust port to an outside of the cooking device body, the exhaust duct having an exhaust guide plane that extends from the exhaust port toward the outside of the cooking device body, and a casing that contains the fan and having an outlet port that discharges the air from the heating chamber into the exhaust duct, the casing being disposed inside the exhaust duct, wherein the outlet port faces the exhaust guide plane, such that an air flow from the outlet port makes contact with the exhaust guide plate to generate a turbulent air inside the exhaust duct.

2. The cooking device of claim 1, wherein an angle of the blowing direction with respect to the exhaust guide plane is between 20 degrees and 85 degrees.

3. A cooking device, comprising:

a cooking device body having a heating chamber that heats an object;

a fan, having a bladed wheel that discharges air of the heating chamber; and a casing that contains the fan and directs the air of the heating chamber to an exhaust duct through an exhaust port, the exhaust duct that guides the air discharged by the fan to the outside of the cooking device body, the exhaust duct having an exhaust guide plane that extends from the exhaust port toward the outside of the cooking device body, wherein the casing is disposed inside the exhaust duct and comprises:

an arc-shaped guide plane that guides an air flow generated by a rotation of the bladed wheel; and an outlet port that extends from a part of the arc-shaped guide plane; and wherein the outlet port faces the exhaust guide plane, such that an air flow from the outlet port makes contact with the exhaust guide plate to generate a turbulent air inside the exhaust duct.

4. The cooking device of claim 3, wherein the bladed wheel is a sirocco bladed wheel that consists of a plurality of blades, and a rotation center side of each blade is arranged rearward in the rotating direction of the bladed wheel with respect to an outer edge side of each blade.

* * * * *